US007513808B1

(12) United States Patent
Murphy

(10) Patent No.: US 7,513,808 B1
(45) Date of Patent: Apr. 7, 2009

(54) LEVER POWERED WATERCRAFT

(76) Inventor: Stephen Christopher Murphy, 365 Waiama Way, Haiku, HI (US) 96708

( * ) Notice: Subject to any disclaimer, the term of this patent is extended or adjusted under 35 U.S.C. 154(b) by 0 days.

(21) Appl. No.: 11/852,981

(22) Filed: Sep. 10, 2007

Related U.S. Application Data

(63) Continuation of application No. 11/388,761, filed on Mar. 23, 2006, now Pat. No. 7,267,586.

(60) Provisional application No. 60/664,373, filed on Mar. 23, 2005, provisional application No. 60/731,796, filed on Oct. 31, 2005.

(51) Int. Cl.
*B63H 16/18* (2006.01)
*B63H 16/00* (2006.01)

(52) U.S. Cl. ..... 440/32; 440/21

(58) Field of Classification Search ..... 440/32
See application file for complete search history.

(56) References Cited

U.S. PATENT DOCUMENTS 3,154,046 A 10/1964 McLean
3,369,517 A 2/1968 Rosenthal
6,890,226 B2 5/2005 Wang
7,267,586 B1 * 9/2007 Murphy ..... 440/32

FOREIGN PATENT DOCUMENTS

JP 61226392 10/1986

OTHER PUBLICATIONS http://www.pumpabike.com/Site1, Home Page, 1 page downloaded and printed from the World Wide Web on or about Sep. 20, 2006.
http://www.pumpabike.com/Site1, Models, 1 page downloaded and printed from the World Wide Web on or about Sep. 20, 2006.
http://www.pumpabike.com/Site1, Pumpabike, 1 page downloaded and printed from the World Wide Web on or about Sep. 20, 2006.

* cited by examiner

*Primary Examiner*—Jesus D Sotelo
(74) *Attorney, Agent, or Firm*—Knobbe, Martens, Olson & Bear, LLP

(57) ABSTRACT

Embodiments of the disclosure include a flotation device or watercraft propelled through the water using a (ever powered propulsion system. The lever powered propulsion system includes human powered actuating levers operably connected to a reciprocating propulsion device. As a rider powers the levers up and down, that motion translates to the propulsion device, which cycles through a high drag propulsion phase and low drag recovery phase.

18 Claims, 24 Drawing Sheets

104
114
104
108

118
108

124
110
112
108
126

114
104
124
126
116

128
106
106
108

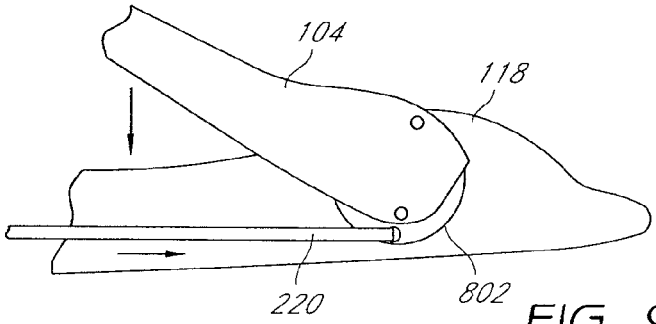
FIG. 8A
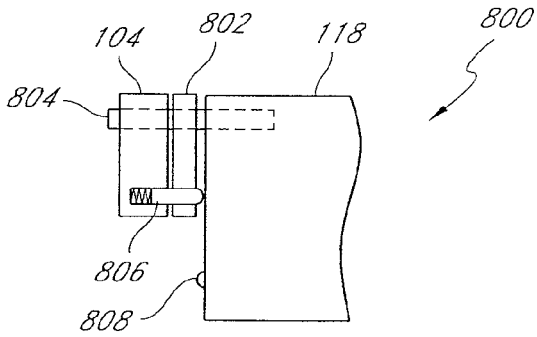
FIG. 8B
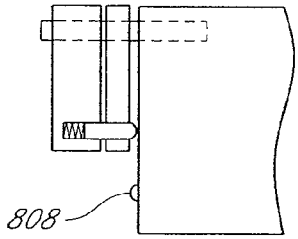
FIG. 8C
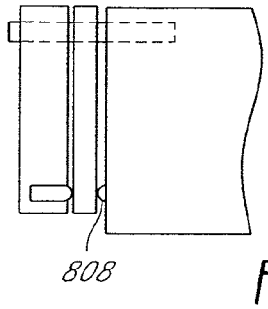
FIG. 8D
FIG. 8

LEVER POWERED WATERCRAFT

PRIORITY CLAIM TO RELATED PROVISIONAL APPLICATIONS

The present application claims priority benefit under 35 U.S.C. § 120 to, and is a continuation of, U.S. patent application Ser. No. 11/388,761, filed Mar. 23, 2006, entitled "Lever Powered Watercraft," which claims priority benefit under 35 U.S.C. § 119(e) from U.S. Provisional Application No. 60/664,373, filed Mar. 23, 2005, entitled "Lever Powered Board," and No. 60/731,796, filed Oct. 31, 2005, entitled "Lever Powered Board." The present application incorporates the foregoing disclosures herein by reference.

BACKGROUND OF THE INVENTION

1. Field of the Invention

The present disclosure relates to the field of water borne devices. More specifically, the disclosure relates to human powered water borne devices, such as surfboards, paddleboards, wind surfboards, wakeboards, canoes, kayaks, and boats including sailboats.

2. Description of the Related Art

Technology for propelling non-motorized watercraft through water has not advanced significantly. For example, surfers and other human powered watercraft are often propelled through the water by a rider reaching toward a forward position, dropping their hand in the water, dragging their hand through the water toward a rearward position, removing their hand from the water and starting over. By alternating this motion with each hand, the rider propels themselves and their particular flotation device forward through the water. This action is generally referred to as "paddling," and is widely employed by surfers, sponge boarders, and many other action water sports.

To obtain increased speed, a rider may grasp one end of one or more oars or paddles, and drag the other end through the water to propel, for example, canoes, surfboards, and all manner of boats through the water. Other recreational watercraft allow for a pedaling motion to be mechanically translated to a propeller or paddle wheel. Still other watercraft rely on a bouncing motion to oscillate hydrofoils to create forward thrust. Such oscillating hydrofoils are commercially available under the name "Pumpabike."

SUMMARY OF THE INVENTION

Aspects of the present disclosure include a flotation device propelled through the water using a lever powered propulsion system. For example, the disclosure includes a watercraft comprising one or more human powered actuating levers operably connected to a high low drag propulsion device. As a rider powers the levers up and down, that motion translates to the high low drag propulsion device, which cycles through a high drag propulsion phase and low drag recovery phase.

In an embodiment, a rider of a surfboard uses weight and muscle energy to drive up and down opposing telescoping levers whose motion is similar to the blades of scissors. In an embodiment, each of the levers are operably linked to a hingable fin. For example, as a rider presses one lever toward a deck of the surfboard in a power stroke, one or more fins begin to move from a forward position toward a rearward position. As the fin begins to push in this direction against water, it hinges toward a vertical high drag position, and its reward motion propels the surfboard forward.

Once the power stroke is complete, the rider lifts the lever in a recovery stroke. As the lever is lifted, the one or more fins mechanically begin to move from a reward position toward a forward position. As the fin begins to push in this direction against water, it hinges toward a horizontal low drag position, and its forward motion recovers to the front of the surfboard without substantially causing drag on the forward moving surfboard. Once recovered, the cycle repeats with another power stroke. In an embodiment using two opposing levers, at least one fin is in the high drag (propulsion) phase while the other is in the low drag (recovery) phase, thereby advantageously providing substantially continuous propulsion.

In an embodiment of the disclosure, the actuation of the levers is hydraulically translated into the back and forth motion of the fins. In an embodiment, the actuation of the lever is mechanically translated into the back and forth motion of the fins. In yet another embodiment, at least one fin travels in a retractable water channel. In an embodiment, the surfboard comprises two side-by-side retractable water channels. In yet another embodiment, one fin is approximately centered travels back and forth in a forward portion of the surfboard, while another fin is approximately centered and travel back and forth in a rearward position of the surfboard. In yet another embodiment, the levers are operably connected to reciprocating and retractable oars.

BRIEF DESCRIPTION OF THE DRAWINGS

FIG. 8 illustrates a simplified exemplary transmission according to an embodiment of the disclosure.

DETAILED DESCRIPTION OF THE PREFERRED EMBODIMENT

Figure 1A:
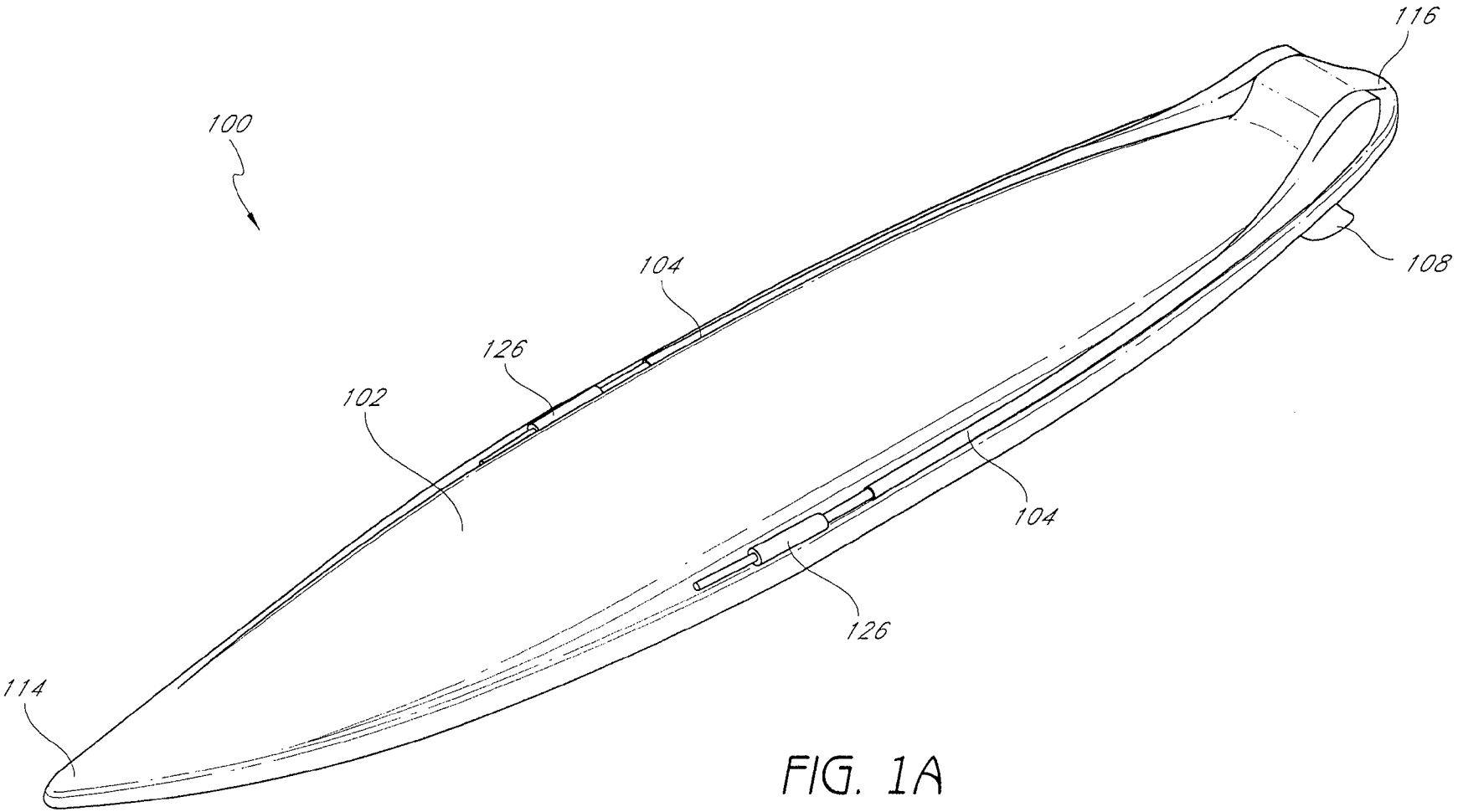
FIG. 1A illustrates a simplified exemplary top front perspective view of a lever powered watercraft, according to an embodiment of the disclosure.

Embodiments of the disclosure include a flotation device or watercraft propelled through the water using a lever powered propulsion system. The lever powered propulsion system includes human powered actuating levers operably connected to a propulsion device. As a rider powers the levers up and down, that motion translates to the propulsion device, which cycles through a high drag power phase and low drag recovery phase.

The watercraft and its component parts can be deployed in a variety of configurations, design priorities, organization, and scaling depending on the objective of the rider and the requirements of the conditions. For example, embodiments of the watercraft disclosed herein are meant for a wide range of uses including basic flat water navigation to extremely large and fast wave riding. Moreover, the watercraft efficiently allows a rider to apply body weight and muscle energy to a cyclic propulsion device. For example, a rider transmits force to the propulsion system by applying bodyweight and muscle energy to collapsible levers hingably attached to the hull. In an embodiment, the point of attachment redirects the up and down stroke of the levers to a horizontal stroke by an arcing motion created as the lever rotates around a pivoting point or fulcrum. In an embodiment, the mechanical advantage of the levers is redirected to hydraulic components. For example, a short leveraged stroke of the lever is converted into a long less-leveraged horizontal stroke. The force of the horizontal stroke is translated into a high drag phase of a fin, bag, foil, split foil, or the like, in the water, which pushes against the water to propel the rider and watercraft forward. Although disclosed herein with respect to particular exemplary embodiments, an artisan will recognize from the disclosure herein that the relative lengths of the levers, mechanical gearings, and hydraulic variable values can all be determined to suit the needs of the intended application.

The watercraft may also be thought of as a foil that contributes lift as well as resistance in proportions suiting the intention of the rider. In some cases, the lift can be smaller and intended to promote early planning of the hull. In other cases, the lift can be larger and intended to lift the hull out of the water to, for example, ride on the foils.

In an embodiment, a rider may advantageously collapse the levers and propulsion system into the hull at any time by letting go of the levers and allowing springs or other tension devices to self close and stow the levers, or simply manually stowing the same. This self closing feature advantageously assists a rider in moving water, such as, for example, breaking waves.

In an embodiment, the watercraft is about twelve feet long (12') by about twenty seven inches (27") wide, although an artisan will recognize from the disclosure herein many sizing and design choices that highlight advantageous for particular applications, such as, for example, flat water, breaking waves, or large fast breaking waves. In an embodiment, the hull comprises materials commercially used in modern surfboard or windsurfboard construction, such as, for example, expanded polystyrene (eps) foam cores wrapped in a high density foam sandwich having fiberglass on the inside and carbon on the outside. Often, the sandwich is vacuum-bagged together with epoxy resin. In an embodiment, the levers may advantageously be about eighty inches (80") long, comprising handmade asymmetrical hollow carbon tubes with sliding handles and/or handgrips. Moreover, the levers may attach to the hull at the pivot point using an about three quarter inch (¾") urethane tendon. In an embodiment, each lever engages a transmission gear through a spring loaded about five eighths inch (⅝") pin. The pin mates with an about three quarter inch (¾") hole in the gear. The pin disengages from the gear when it encounters a dome shaped bump on the hull forcing the spring loaded pin back far enough that the dome shaped end of the pin is easily pushed out of the way by the sides of the hole in the gear.

The hull shape and dimensions may vary widely depending on the intended use. Hulls intended for surfing breaking waves will much resemble modern surfboards in dimension, design and variation, and will be constructed in much the same way both in terms of process and materials. Flat water and swell riding designs will more closely parallel recent trends in windsurfer hulls becoming shorter, wider, faster, and early planning oriented. Because of the additional equipment onboard, the hull will comprise weight saving materials and techniques like carbon, epoxy, eps, urathane, combinations, or the like, lay-ups and hollow molding techniques. The hull designs and construction techniques may advantageously evolve along similar lines as windsurfers, with early boards being relatively large, stable and slow; and becoming progressively smaller, faster and more maneuverable as rider experience and skill provides critical feedback on performance issues and tastes. The hull described herein is intended as exemplary for a breaking wave. A skilled artisan will recognize from the disclosure herein the pros and cons of various modifications to the hull described herein. In an embodiment, design considerations of the hull include an ability to "water start." That is, the design of the hull in an embodiment allows for a rider to mount the board from a partially submerged orientation, in the way modern windsurfers and surfers do. Such design generally provides for smaller hulls.

As disclosed, the levers transmit body weight and muscle energy to the propulsion system. In an embodiment, the levers also provide stability to the rider. For example, resistance during the recovery phase, or up stroke, allows the rider to pull themselves against the hull in rough water or other weightless or weight-reduced situations. In an embodiment, the levers also advantageously aid in steering, particularly on larger hulls. In addition, the levers may advantageously be locked in a fixed position, adjusted to engage the propulsion system, and include a spring tension device to assist a self closing function. The levers may also mechanically couple to stabilizing devices that deploy when the hull is moving slowly or motionless with respect to the water. In addition to the foregoing, an embodiment of the levers includes sliding handles to maximize rider ergonomics, such as, for example, to more accurately mimic the motion and positioning of the rider's hands during up and down scissor motions. Moreover, the levers may be shaped to become seamlessly integrated into or virtually integrated into the hull when stowed or in the closed position.

The levers may also advantageously be sufficiently strong to withstand their mechanical advantage, which in some embodiments may create loads in excess of about twenty (20) times the rider's weight. Thus, the levers may comprise strong and light materials, such as, for example, carbon, epoxy, or combination composites in the shape of an asymmetrical tube. An artisan will recognize from the disclosure herein composite technologies and reinforcing structures.

In an embodiment, a portion of the levers near a pivot or fulcrum location may comprise metallic reinforcement for reliable durability. In an embodiment, the levers are rigid vertically when close to the body and engaged with the propulsion system, but freely moving when away from the body and disengaged. Moreover, a urethane tendon similar to the ones at the base of a windsurfer mast may contribute flexibility to the lever-hull connection providing for a variety of lever options and lever orientations.

In an embodiment, a transmission mechanically connects a lever to a propulsion system. In an embodiment where the propulsion system comprises a hydraulic system, the transmission converts the lever stroke into a powerful short horizontal stroke that is applied to the hydraulic system. The transmission mechanically connects the lever to a compression system of the hydraulic compression cylinder by way of a shaft. In an embodiment, the shaft is under tension in the power phase of the lever stroke, thereby advantageously reducing strength and weight limitations of the shaft. In addition to the foregoing, the transmission assists in disengaging the levers from the propulsion system.

An artisan will recognize from the disclosure herein a wide variety of transmission devices that translate the human force on the levers to the action of the propulsion system, as well as the pros and cons of various material choices. In an embodiment, composite materials well known for their strength to weight advantages and water resistance are used for many of the components of the disclosed watercraft.

In an embodiment, the propulsion system is similar to a hydraulic debooster. The propulsion system coverts a short powerful stroke it receives from the transmission into the long strokes used by propulsion fins. An artisan will recognize from the disclosure herein a wide variety of hydraulic systems and designs to increase the efficiency and reduce the weight of the propulsion system. For example, the hydraulic system may comprise components, designs, or the like from systems applied in, for example, the aviation industry. Such aviation systems adapt hydraulics in space constricted and weight sensitive applications.

In an embodiment, the propulsion device includes use of energy in the upstroke of the lever. For example, similar to how toe clips on the pedals of a bicycle crank allow a rider to contribute muscle energy during his pedaling upstroke, particular hydraulic system designs include a return that applies energy of the lever upstroke to the propulsion system. Moreover, air in the hydraulic system may advantageously comprise a light weight alternative to a conventional spring for loading the upstroke and as a way to minimize "slip/stick" on hydraulic shafts as the shafts overcome inertia when reversing direction. The air may also advantageously provide additional power to the initiation of each power stroke. By compressing air on the upstroke, pressurizing fluid or both, a rider's contributes on the down stroke and creates desirable resistance in the upstroke. That resistance may advantageously counter any weightlessness created by weighting the down stroke, thereby keeping the rider in more secure contact with the hull. For surfing applications in breaking waves, such resistance aids in propelling the watercraft beyond whitewater and may override considerations of efficiency in calibrating the input to the up and down strokes.

As disclosed in the foregoing, the watercraft is propelled forward by the manual stroke of the rider being expressed against the resistance of a high drag device in the water. At the end of each stroke the high drag device is reoriented into a low drag state, and returned to the starting position. For purposes of this disclosure, the wide variety of devices, mechanical connections, or combinations, that can be cyclically oriented through high and low drag states in the water, will be referred to as a "hilo," or "hilo device."

In an embodiment, the hilo comprises a foil that pivots freely at a point forward of center. When pulled forward through the water, the hilo automatically seeks its lower drag orientation with increasing efficiency as the pivot location is moved forward. When pushed backwards, the foil automatically reorients itself seeking its lowest drag state. However, proper construction of a carriage may advantageously catch the hilo such that its position corresponds to a high drag state.

In an embodiment, the action of the hilo propels the watercraft forward and in some cases, assists in planning the hull like a conventional surfboard on a wave. In an embodiment, the shape and action of the foil, such as, for example, an asymmetrical foil, may advantageously generate sufficient lift to cause the hull to lift out of the water and ride on the foils. It is also possible to add separate foil structures to contribute lift. Thus, the present disclosure encompasses each of these designs and an artisan will recognize from the disclosure herein that the hull and the foils may be altered for different uses, conditions, and the like, including many permutations calibrating design variables inherent in the overall watercraft and propulsion system.

To facilitate a further understanding of the disclosure, the remainder of the description describes the invention with reference to specific drawings, wherein like reference numbers are referenced with like numerals throughout.

FIGS. 1A-1F illustrate simplified exemplary views of a lever powered watercraft 100, according to an embodiment of the disclosure. As shown, the watercraft 100 comprises a hull 102, a pair of hinge-mounted levers 104, a pair of hilo devices 106 and one or more fins 108. As shown, the hull comprises a surfboard-like design including a top or deck 110, a bottom 112, a nose 114, a tail 116, and a raised tail block 118. In an embodiment, the hull 102 may comprise materials commonly used to make surfboards, wakeboards, windsurfing boards, knee boards, bogie or body boards, canoes, kayaks, combinations of the same or the like, including composite materials, foams, epoxies, wood, aluminum framings or skeletons, plastics, fiberglass, or the like. Moreover, the hull 102 may be shaped in a wide variety of shapes providing the desired maneuverability balanced against weight and storage capacity within its thickness for propulsion systems. However, an artisan will recognize from the disclosure herein a wide variety of dimensions including virtually all conventional and future long, short, and hybrid board dimensions shaped from all conventional and future materials. Moreover, an artisan will recognize from the disclosure herein a wide variety of shapes and sizes for the hull 102 that emphasize different uses and different rider specifications, similar to considerations used in surfboard and windsurfing board design. For example, the hull 102 may include a wide variety of nose rockers 120 (distance the nose 114 is raised from the horizontal of the bottom 112) and/or a tail rockers 122 (distance the tail 116 is raised from the horizontal of the bottom 112).

An artisan will also recognize from the disclosure herein that the hull 102 may comprise any material or combination of materials suitable for use in water. Moreover, an artisan will also recognize from the disclosure herein that the hull 102 may comprise a wide variety of shapes, including canoe, kayak, sail boat, or other watercraft shapes that may or may not include pontoons or outriggers. In addition, the artisan will recognize from the disclosure herein that the propulsion system disclosed herein may advantageously be adapted for virtually all water borne sporting crafts, such as paddleboards, wind surfboards, wakeboards, canoes, kayaks, watercraft and boats including sailboats.

FIGS. 1A-1E also show each lever 104 comprising a curved shape and including telescoping members 124 and handgrips 126. In an embodiment, levers 104 comprise telescoping members comprising an outer tube and an inner tube slideable within the outer tube to create a longer or shorter lever length. When a rider uses the longer length lever, its action translates to longer duration power strokes. Longer strokes can be advantageous for starting and accelerating forward momentum to build speed. However, at a certain speed (for example, based on the geometry of the propulsion system) longer stokes will limit the upper speed of the watercraft 100. Thus, the rider may prefer to shorten the levers 104, translating to shorter faster power strokes to maintain or acquire potentially very high speeds. In addition to longer and shorter lever lengths, which may also be adjusted based on the height of the rider, the levers 104 include the handgrips 126. In an embodiment, the handgrips 126 slide along one of the telescoping members such that when a rider pumps the levers 104 up and down, the handgrips 126 advantageously slide along the levers 104 to adjust to the rider's natural cyclic arc. For example, the handgrips 126 may slide outward when at the tope of a stroke, and inward as the stroke comes down.

In an embodiment, the levers are spring loaded through a tension device such that a rider feels tension on the lifting or recovery stroke. Such tension provides that were the rider to simply release their grip on the hand grips 126, the levers 104 would spring back into the stowed position to allow the rider to simply coast, surf, or the like. Moreover, the levers 104 may perform many functions in addition to leveraging the up and down strokes of the rider. For example, in an embodiment, the levers disengage from the propulsion system and are lockable at any position. Thus, a rider may advantageously disengage and lock the levers 104 in, for example, an even position with respect to one another such that the rider may balance and/or turn using the levers 104.

Figures 1B, 1C, 1D, 1E, 1F:
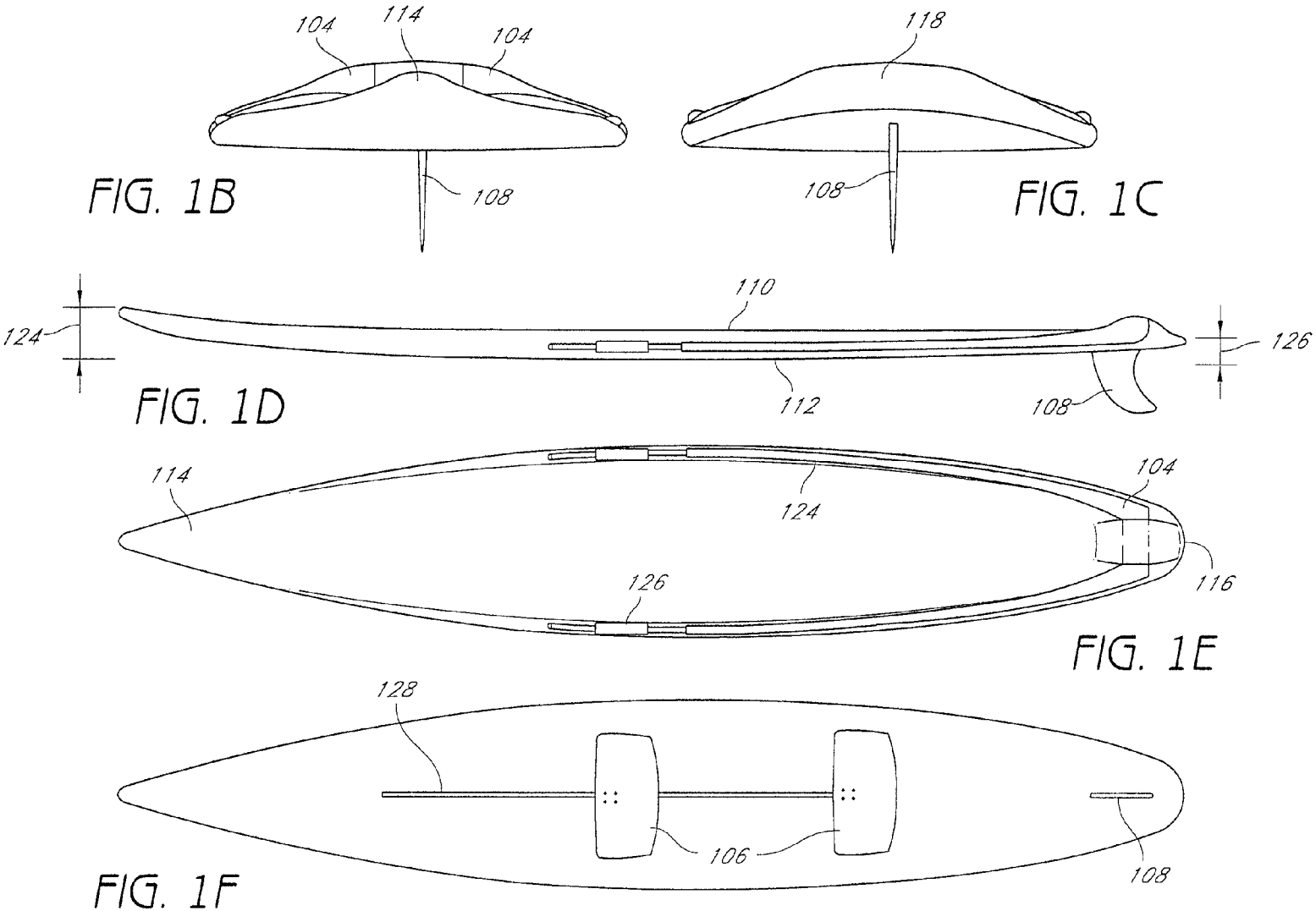
FIG. 1B illustrates a simplified exemplary front view of the watercraft of FIG. 1A.
FIG. 1C illustrates a simplified exemplary rear view of the watercraft of FIG. 1A.
FIG. 1D illustrates a simplified exemplary side view of the watercraft of FIG. 1A.
FIG. 1E illustrates a simplified exemplary top view of the watercraft of FIG. 1A.
FIG. 1F illustrates a simplified exemplary bottom view of the watercraft of FIG. 1A.

FIG. 1F illustrates a pair of hilos 106, each comprising a substantially rectangular fin operably connected to one or the other of the levers 104. As shown in FIG. 1, the hilo devices 106 and the levers are in the stowed position, which may include either indentations into the bottom 112 of the hull 104, compression of the material of the hilo 106, or combination thereof. During operation, the hilos 106 travel in opposing cycles that meet near the center of the hull 102. For example, in an embodiment, the forward fin travels from the center of the hull 102 toward the nose 114 as the rearward fin travels from the center toward the tail 116. After reaching the respective ends, the forward fin then travels back toward the center of the hull 102 as does the reward fin. Thus, as the fins separate, the forward fin is in the recovery phase while the rearward fin is in the power phase. As the fins come back toward each other, the forward fin is in the power phase while the rearward fin is in the recovery phase. Disclosure of the motion of the levers 104, the propulsion system, and the hilo devices 106 are provided in further detail below.

Figure 2:
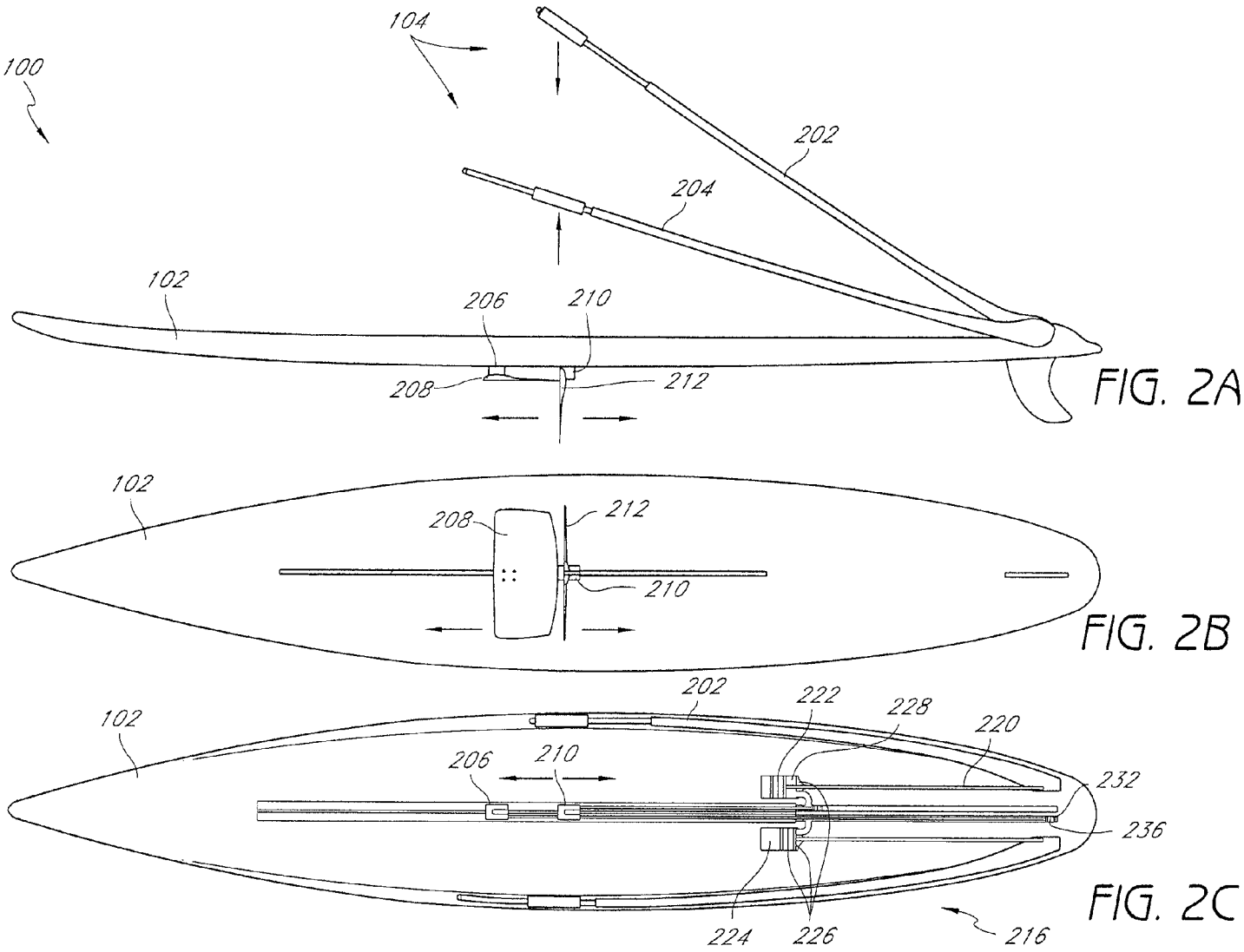
FIGS. 2-7 illustrate a simplified exemplary system cycle according to an embodiment of the disclosure.
Figure 3:
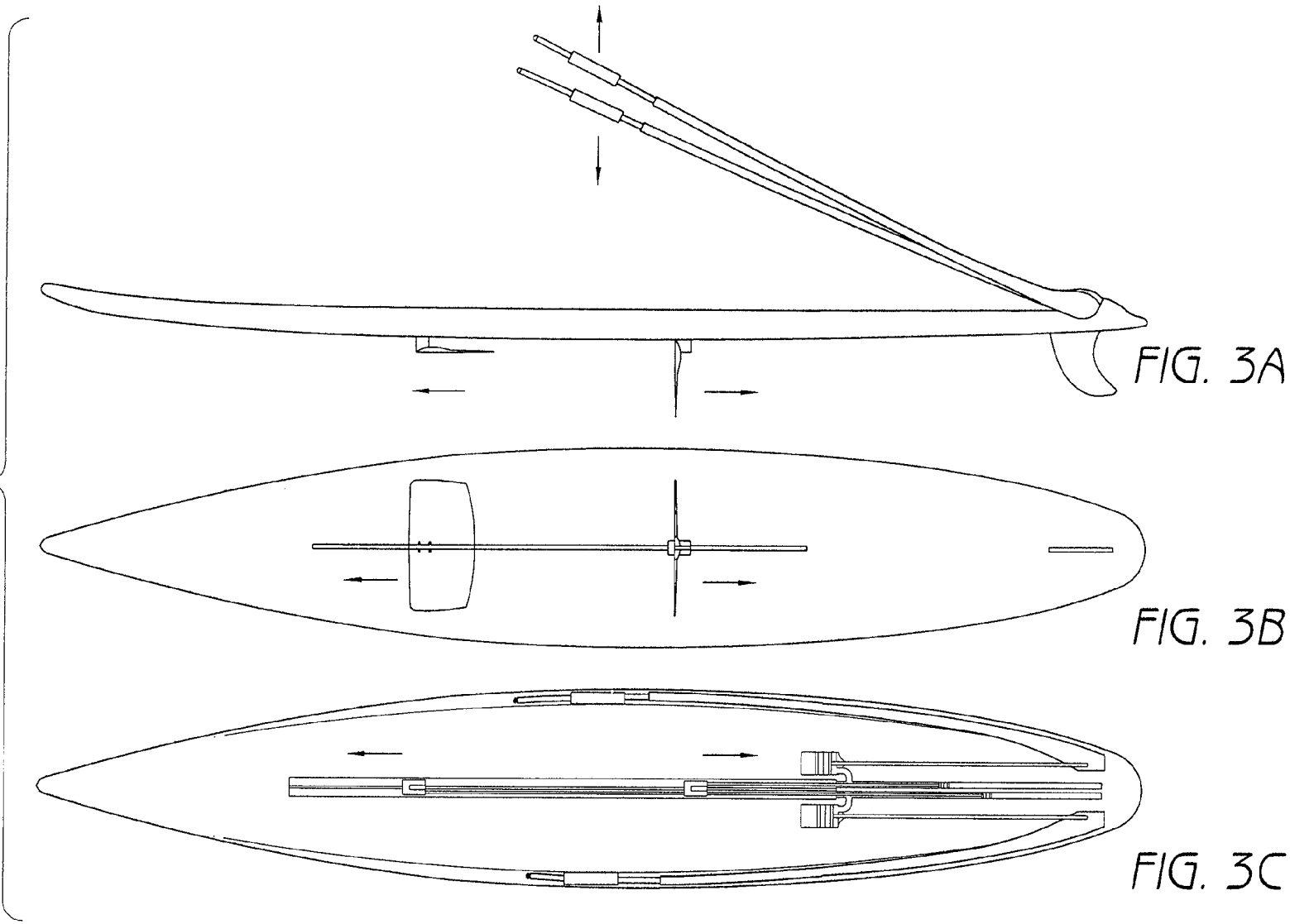
Figure 4:
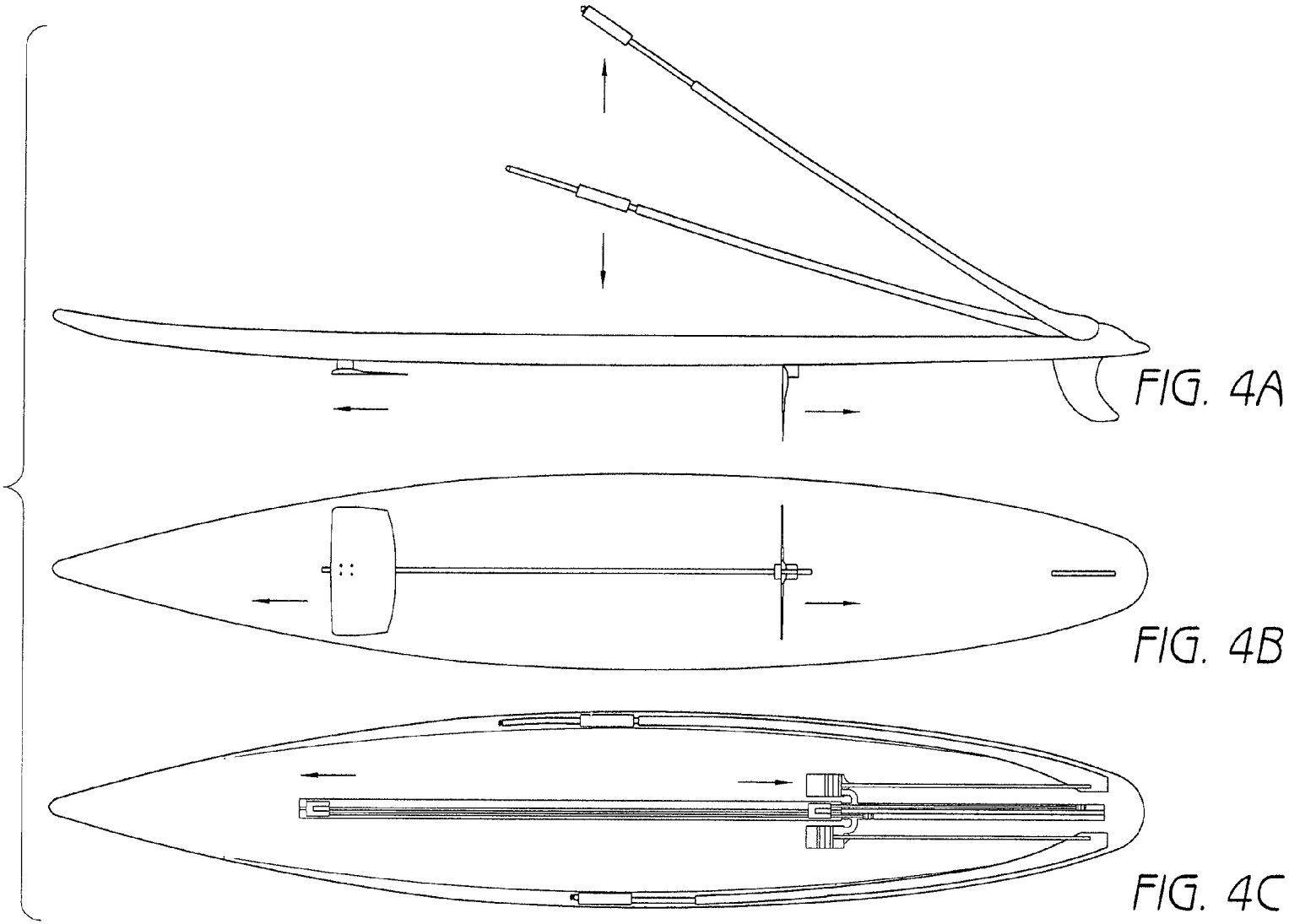
Figure 5:
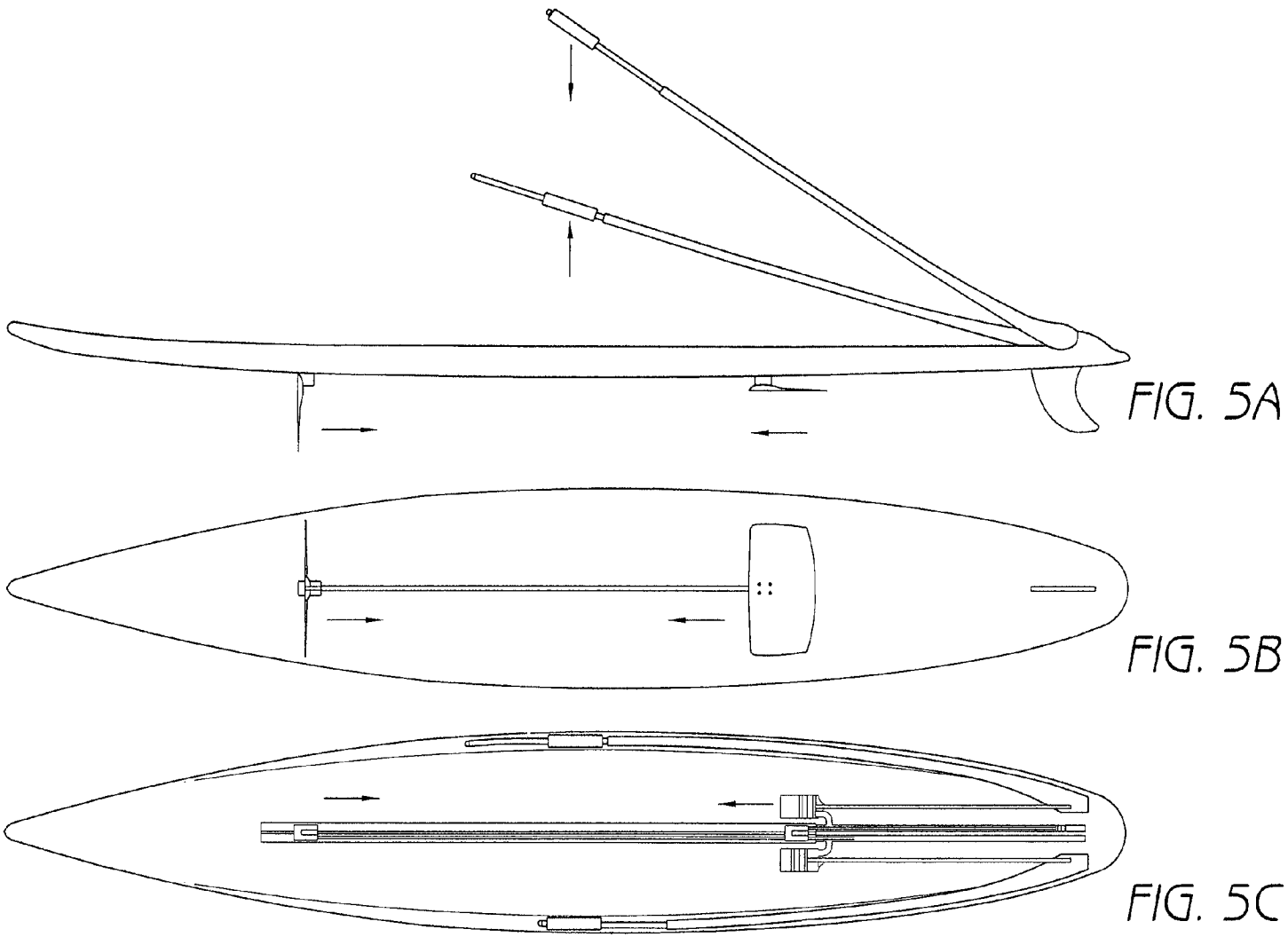
Figure 6:
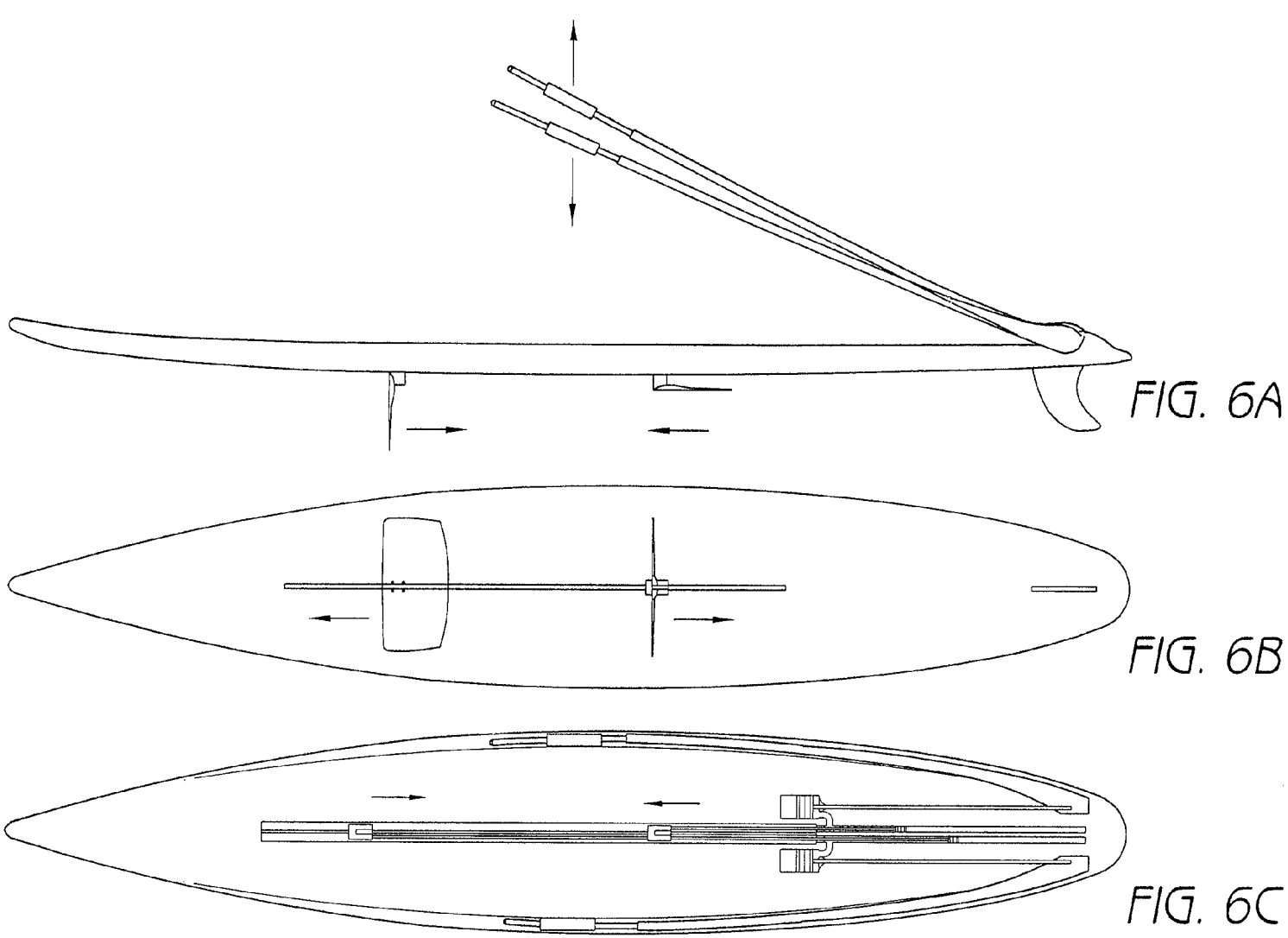
Figure 7:
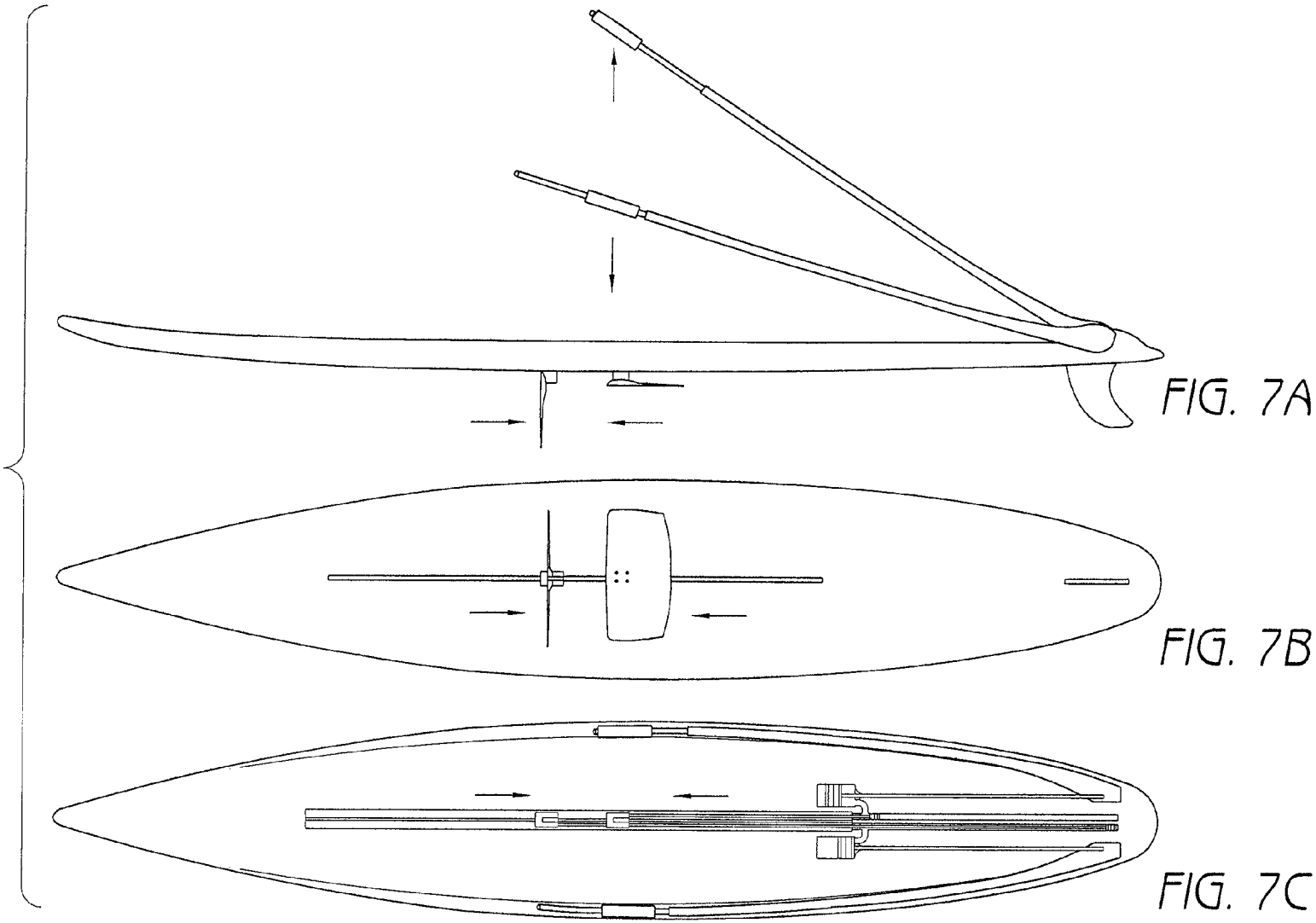

FIGS. 2-7 illustrate a simplified exemplary system cycle according to an embodiment of the disclosure. As shown in FIG. 2, the watercraft 100 is illustrated in three views, a left or port side view, a bottom view, and a top transparent view showing details of a propulsion system comprising a hydraulic system. The port side view illustrates the levers 104 comprising a raised right or starboard side lever 202 and a lowered left or port side lever 204. At the beginning of the illustrated cycle, the rider loads the starboard lever 202 by applying their body weight and muscle in a downward movement, while the rider simultaneously unloads the port lever 204 by lifting in an upward movement. The port side view of FIG. 2 also shows the forward carriage 206 and fin 208, operably connected to the port lever 204, in a low drag (or recovery) phase as the lifting of the port lever 204 causes the carriage 206 and the fin 208 to travel forward. Meanwhile, the rearward carriage 210 and fin 212, operably connected to the starboard lever 202, in a high or power phase as pushing down the starboard lever 202 causes the carriage 210 and the fin 212 to travel rearward.

The bottom view of FIG. 2 illustrates the low drag phase of the forward fin 208 and the high drag phase of the rearward carriage 210 and fin 212. Moreover, the bottom view shows a carriage track slot 214 in which the forward and rearward carriages 206, 210 run.

The top transparent view of FIG. 2 illustrates the hydraulic system 216. In an embodiment, the hydraulic system comprises two independent systems with the upper system translating motion of the starboard lever 202 into motion of rearward carriage 210, and the lower system translating motion of the port lever 204 into motion of the forward carriage 206. Each hydraulic system includes a shaft 220 operably connected to a compression piston 222 inside a compression cylinder 224 with appropriate compression seals 226 to ensure hydraulic fluid 228 is not lost. As the shaft 220 moves the compression piston 222, the hydraulic fluid 228 acts upon an actuation piston 232 inside an actuation cylinder 234 with appropriate actuation seals 236. The actuation piston 232 operably connects to an actuation shaft 238, which operably connects to one of the carriage assemblies 206, 210. Thus, as shown in the top transparent view of FIG. 2, the downward action of the starboard lever 202 is translated into a rearward movement on the shaft 220 that causes the upper compression piston 222 to force the hydraulic fluid 228 out of the upper compression cylinder 224 into the upper actuation cylinder 238. The fluid 228 forced into the upper cylinder 238 causes the upper actuation piston 232 to travel rearward, pulling the upper actuation shaft 238, and thus the rearward carriage assembly 210 rearward. The rearward motion of the carriage 210 causes the fin 212 to seek a low drag position; however, as discussed in the foregoing, as the fin 212 rotates, it catches at a high drag position and as the carriage 210 moves rearward, the fin applies a force against the water.

Meanwhile, the opposite action is carried out on the lower hydraulic system as the port lever 204 is raised. For example, the raising of the port lever 204 causes the lower shaft, and thus, the lower compression piston, to move forward and drag the hydraulic fluid back into the compression chamber. As the fluid is dragged out of the actuation chamber, the actuation piston is dragged forward in the actuation chamber. The forward movement of the actuation piston is applied to the actuation shaft and then the forward carriage 206, thus causing the fin 208 to move forward in a low drag state.

FIGS. 3-7 show the remaining cycle as the starboard and port levers 202, 204 are cycled up and down. Through the opposing motion of the fins 208, 212, one fin is in or entering the high drag or power phase while the other is in or entering the low drag or recovery phase. However, were a rider to simple stop applying movement to the levers 202, 204, the each of the fins 208, 212 advantageously move into a low drag state (as the high drag fin suddenly is slower than passing water, it moves to its low drag state as well) as the hull 102 coasts. Once the rider begins to pump again, one of the fins 208, 212 will begin to move rearward faster than the passing water and thereby rotate into its high drag state again without having to reset the levers 202, 204.

FIG. 8 illustrates a simplified exemplary transmission 800 according to an embodiment of the disclosure. As shown in FIG. 8, the transmission 800 comprises a gear 802 releasably connected to the lever 104 and the shaft 220, each of which is mounted to the tail block assembly 118 through an off axis hinge or pivot 804. As further shown in FIG. 8, the gear 802 and the lever 104 may be connected through a spring-loaded retractable pin 806. Thus, while the retractable pin is engaged, movement of the lever 104 translates into movement of the shaft 220. As the lever 104 is lowered, the gear 802 rotates on the off axis pivot 804, which drags the shaft 220 rearward, which drives the hydraulic system.

However, when the lever 104 rotates around the off axis pivot 804, the lever 104 and gear 220 become sufficiently low (or near the deck 110), a bump or nub 808 eventually catches the retractable pin 206 and disengages the lever 104 from the gear 802, and thus, from the hydraulic system. Such release may assist in allowing the lever 104 to move from a low position off the deck 110, to a stowed position without affecting the hydraulic system.

Although disclosed with reference to the gear 802 and retractable pin 808, an artisan will recognize a great number of mechanical, other or combination systems that translate the movement of the levers 104 to actuation of the hydraulic system. Moreover, such mechanical, other or combination systems may also release the hydraulic system when moving from a low to a stored state.

Figure 9:
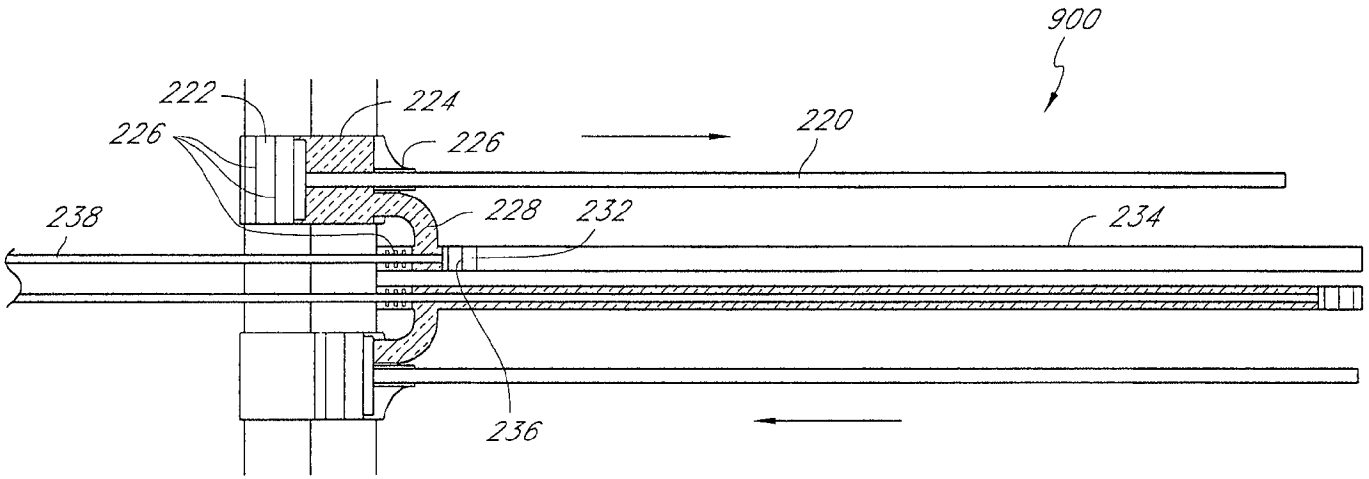
FIG. 9 illustrates a simplified exemplary hydraulic system according to an embodiment of the disclosure.

FIG. 9 illustrates a close up view of a simplified exemplary hydraulic system 900, such as the system disclosed with reference to FIG. 2. When the stroke of the levers 104 is about twenty four to about twenty eight inches (24"-28"), an embodiment includes a fulcrum of about three and one half inches (3½"), a compression stroke of about one and one eighth to about one and five sixteenths inches (1⅛"-1 5/16"), a compression chamber of about a three inch (3") diameter, an actuation stroke of about twenty four to about thirty inches (24"-30"), an actuation cylinder of about three quarter inch (¾") diameter, an actuation shaft of about three eighths inches (⅜") diameter, using hydraulic fluid volume of about thirty five cubic inches (35 $in^3$) and fluid weight of about one pound (1 lb) to produce a pressure of about five hundred and fifty four pounds per square inch (554 $lbs/in^2$) and a drive force of about two hundred and forty four pounds (244 lbs). As shown, the hydraulic system 900 is accepting the power stroke from the starboard lever 202 (and thus the rearward fin 212), and is accepting the recovery stroke from the port lever 204 (and thus the forward fin 208).

Although disclosed with reference to certain parameters, an artisan will recognize from the disclosure herein how each element of the hydraulic system 900 affects the efficiency or performance of the translation of lever motion to carriage motion, and may determine more efficient hydraulic designs or specifications to emphasis desired characteristics of the system.

Figure 10:
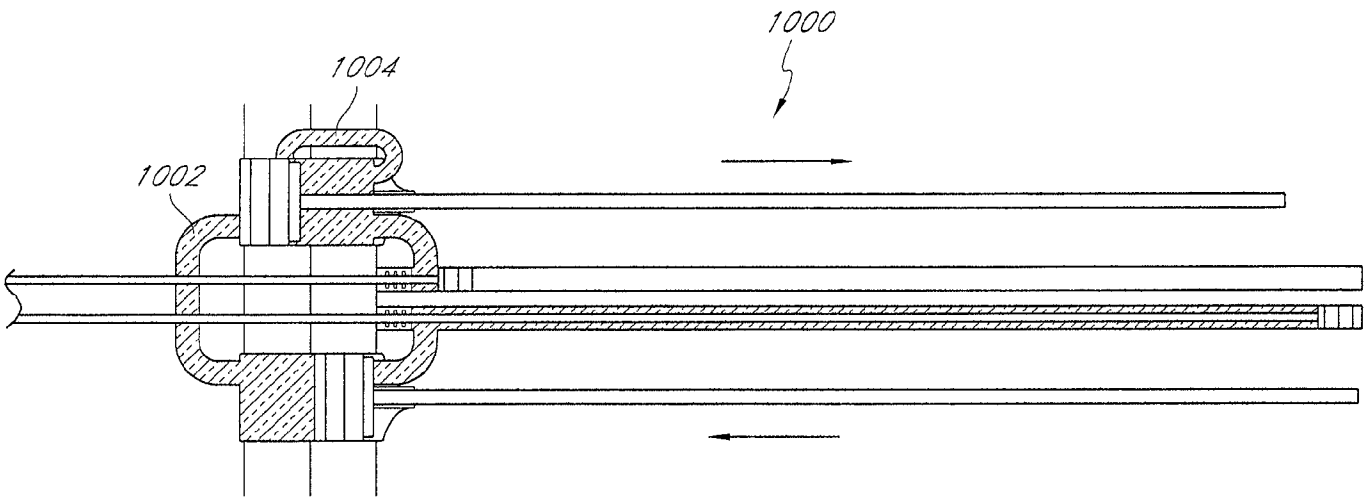
FIG. 10 illustrates a simplified exemplary coupled hydraulic system according to an embodiment of the disclosure.

FIG. 10 illustrates a simplified exemplary coupled hydraulic system 1000 according to an embodiment of the disclosure. As shown in FIG. 10, the coupled hydraulic system 1000 is similar to the hydraulic system 900 of FIG. 9, and further includes a coupling tube 1002 and a return tube 1004. The coupling tube 1002 provides for hydraulic exchange between the compression chambers. This coupling allows for the lifting or recovery stroke of one of the levers 104 to assist in the pressing or power stroke of the other lever 104. Thus, the action of the levers becomes analogous to using toe clips on a bicycle crankshaft. However, because of the coupling, the levers 104 begin to act like a bicycle crank shaft in that the levers 104 now must operated in opposite, whereas the decoupled hydraulic system 900 may operate in opposite, in parallel, or any other mode comfortable to the rider. In such a coupled embodiment, the levers 104 and the transmission 800 may advantageously include gearing allowing for the decoupling of the levers 104 and the gear 802 in order to, for example, coast with the levers 104 in equal positions. Such decoupling may include a locking mechanism that locks the levers 104 in place to provide for balance and/or steering. In an embodiment, the levers 104 may be pushed outward to disengage the gearing 802, and in an embodiment engage a position lock. Brakes or other fixture devices could also be used to fix the levers 104 after decoupling from hydraulic system.

Figure 11:
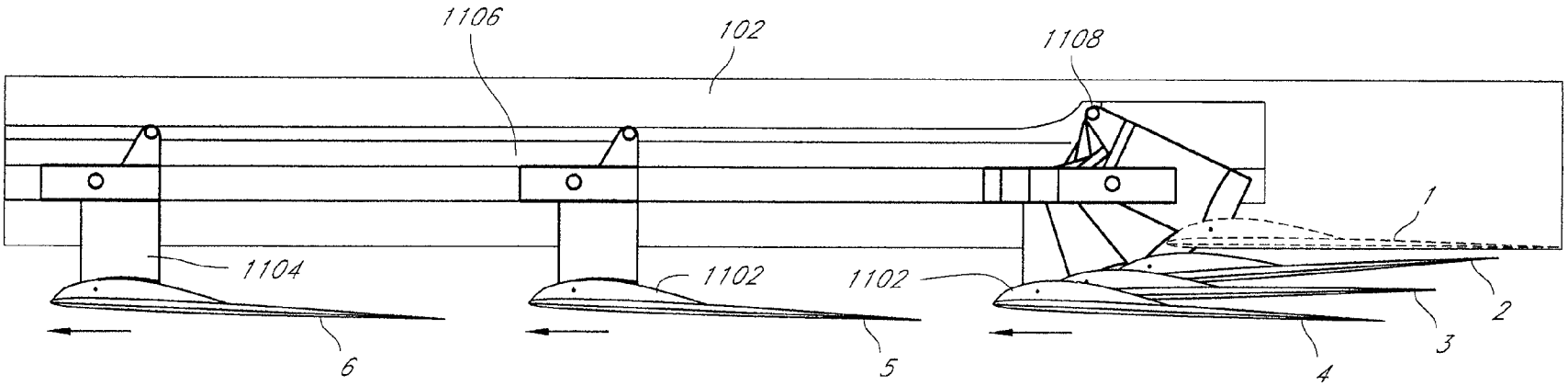
FIG. 11 illustrates a simplified exemplary hilo and carriage moving from a stowed position through a recovery phase according to an embodiment of the disclosure.

FIG. 11 illustrates a simplified exemplary hilo 1102 and carriage 1104 moving from a stowed position 1 through a starting phase 2-3 through a recovery phase 4-6, according to an embodiment of the disclosure. As shown in FIG. 11, a hollow track 1106 is within or integral with the hull 102. The track 1106 is shaped to allow the carriage 1104 to freely travel within the track in a back and forth motion. The track 1106 includes a stop 1108 that causes the carriage 1104 to hinge and stow the hilo 1102 within, for example, an indentation of the hull 102 at position 1.

Figure 12:
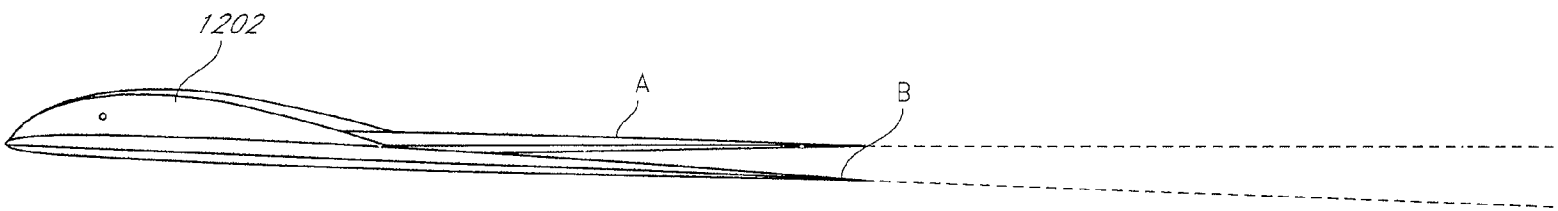
FIG. 12 illustrates a simplified exemplary canted hilo according to an embodiment of the disclosure.

FIG. 12 illustrates a simplified exemplary canted hilo 1202 according to an embodiment of the disclosure. The slight cant (position B) ensures the hilo 1202 reorients in the desired direction, downward, as it is moved rearward with respect to the water, thus entering into its high drag state. Though this cant does create some unwanted drag during the recovery phase, it is expressed usefully as lift. In an embodiment, a set screw may be used to adjust the cant to tune the hilo 1202 to have desired drag/lift characteristics. In another embodiment, the base of the carriage may advantageously be angled to a desired cant. For example, the angle may range from about three to five degrees (3°-5°). However, the cant may be larger to express more lift when lift is desired above the negative efficiency the larger cant causes from drag during the recovery phase.

Figure 13:
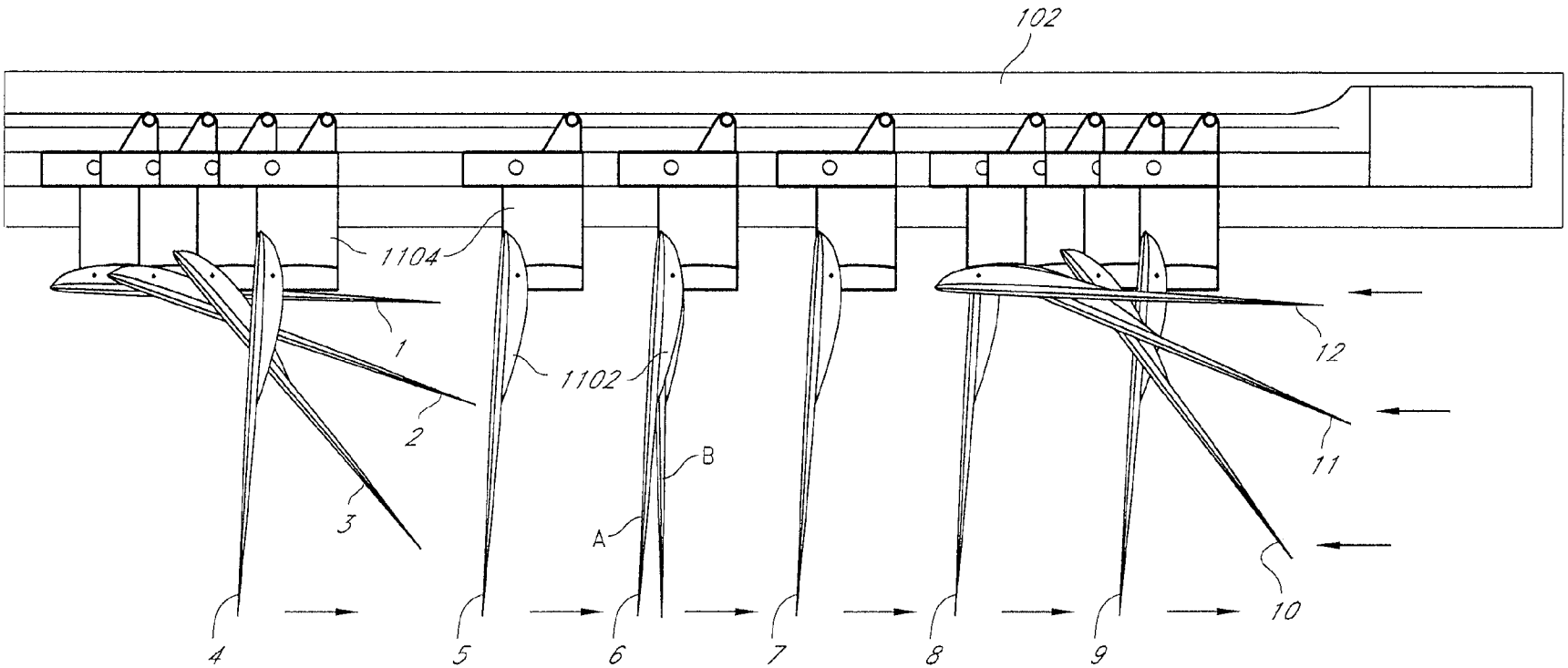
FIG. 13 illustrates the hilo and carriage of FIG. 11 moving through a power phase according to an embodiment of the disclosure.

FIG. 13 illustrates the hilo 1102 and carriage 1104 of FIG. 11 reorienting from a recovery phase 1-3 through a power phase 4-9, and reorienting back into a recovery phase 10-12, according to an embodiment of the disclosure. In the embodiment shown, there are two hilos operating in opposite cycles, thus at least one hilo should almost always be in the power phase. However, when the rider stops moving the levers and coasts, both hilos automatically reorient to low drag state in a "glide mode". Position 6 also illustrates the embodiment of FIG. 12 (slight cant from vertical) that contributes a small amount of lift to the power phase of the stroke.

Figure 14:
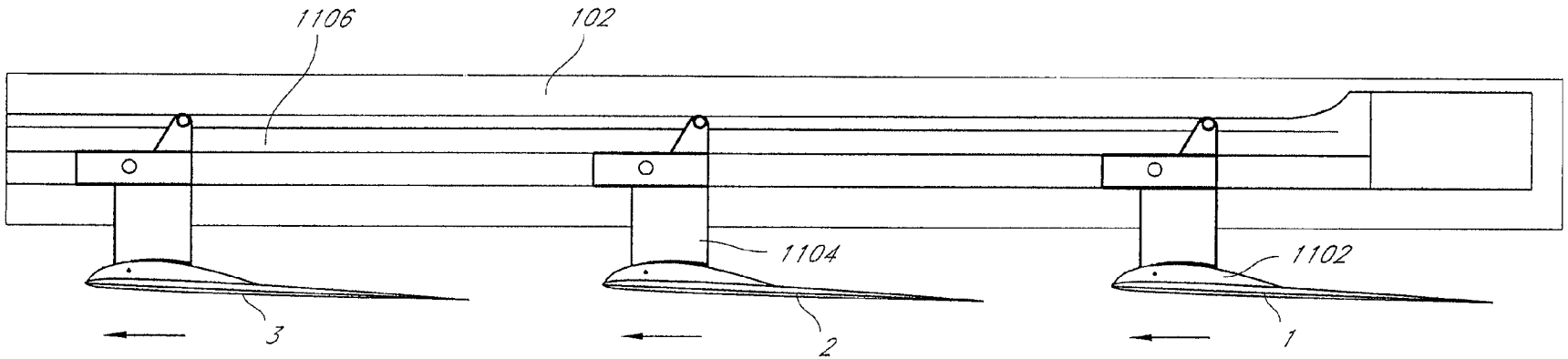
FIG. 14 illustrates the hilo and carriage of FIG. 11 moving through a recovery phase according to an embodiment of the disclosure.
Figure 15:
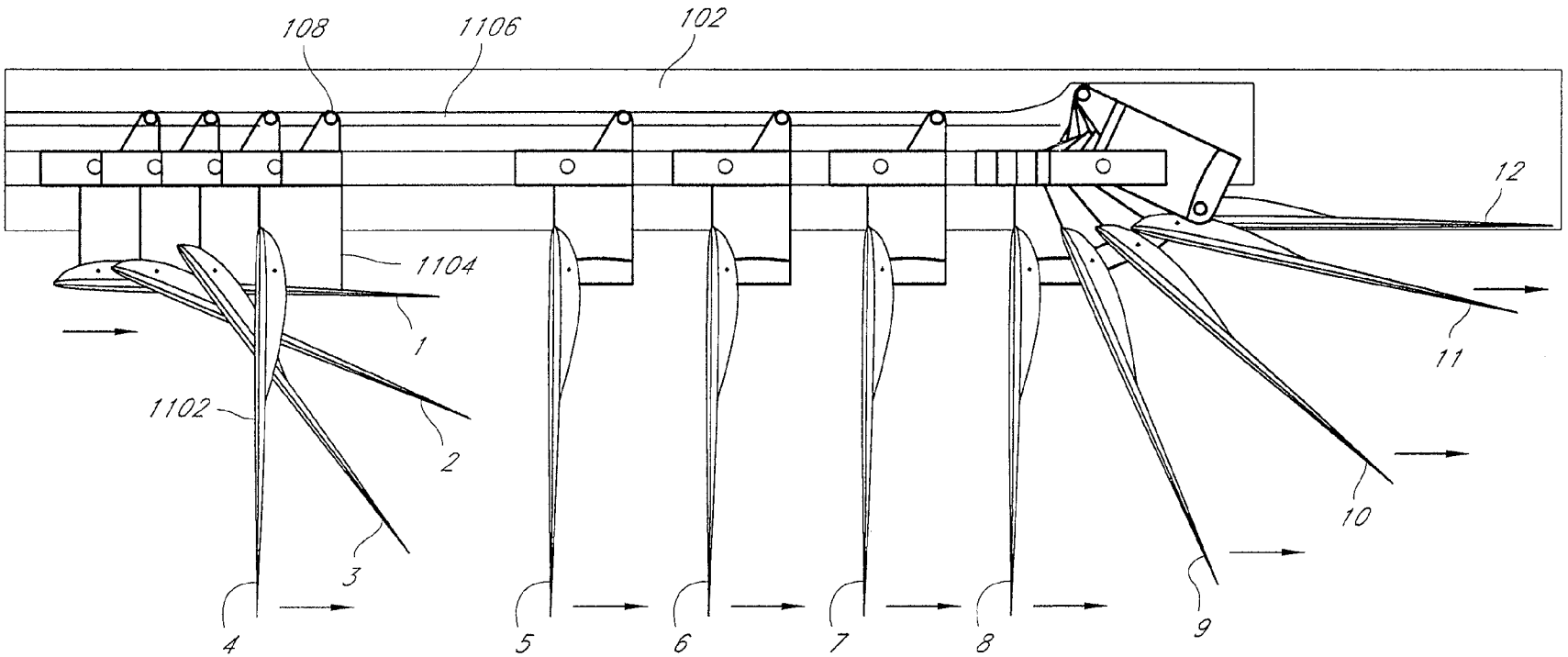
FIG. 15 illustrates the hilo and carriage of FIG. 11 moving from a power phase through a stowed position according to an embodiment of the disclosure.

FIG. 14 illustrates the hilo 1102 and carriage 1104 of FIG. 11 moving through a recovery phase 1-3, according to an embodiment of the disclosure. FIG. 15 illustrates the hilo 1102 and carriage 1104 of FIG. 11 moving from a power phase 1-8 through a stowed position 9-12, according to an embodiment of the disclosure.

Figure 16A:
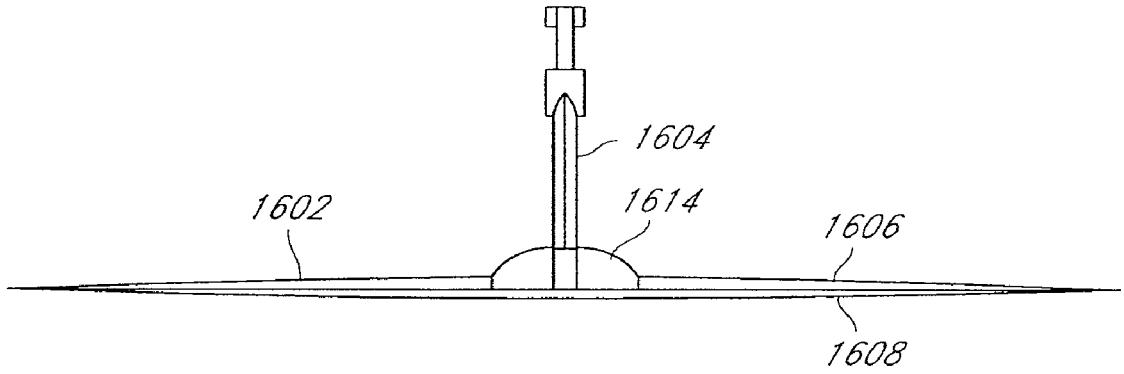
FIG. 16A illustrates a simplified exemplary front view of a hilo and carriage according to an embodiment of the disclosure.
Figure 16B:
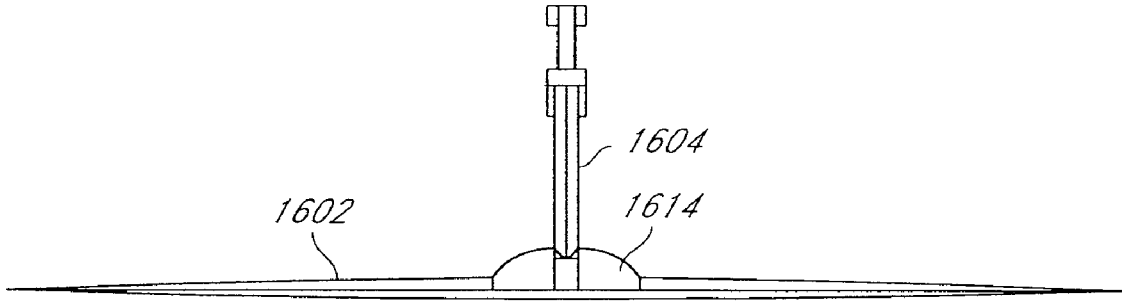
FIG. 16B illustrates a rear view of the hilo and carriage of FIG. 16A.
Figure 16C:
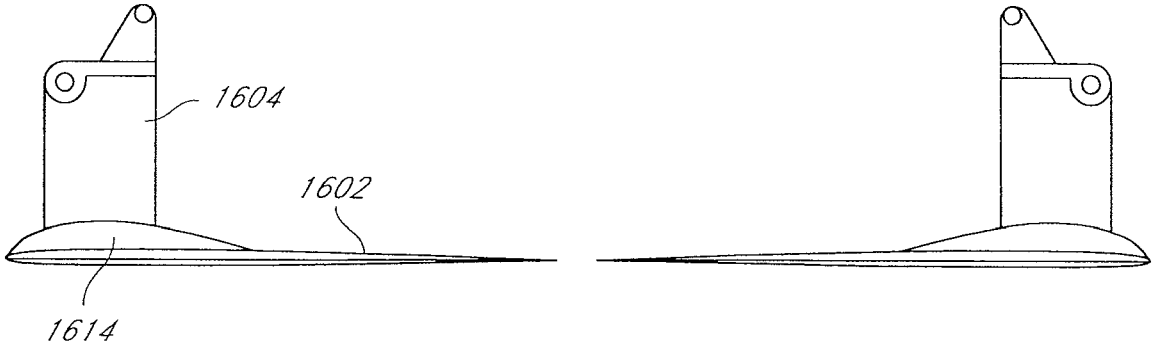
FIG. 16C illustrates a side low drag or recovery phase view of the hilo and carriage of FIG. 16A.
Figure 16D:
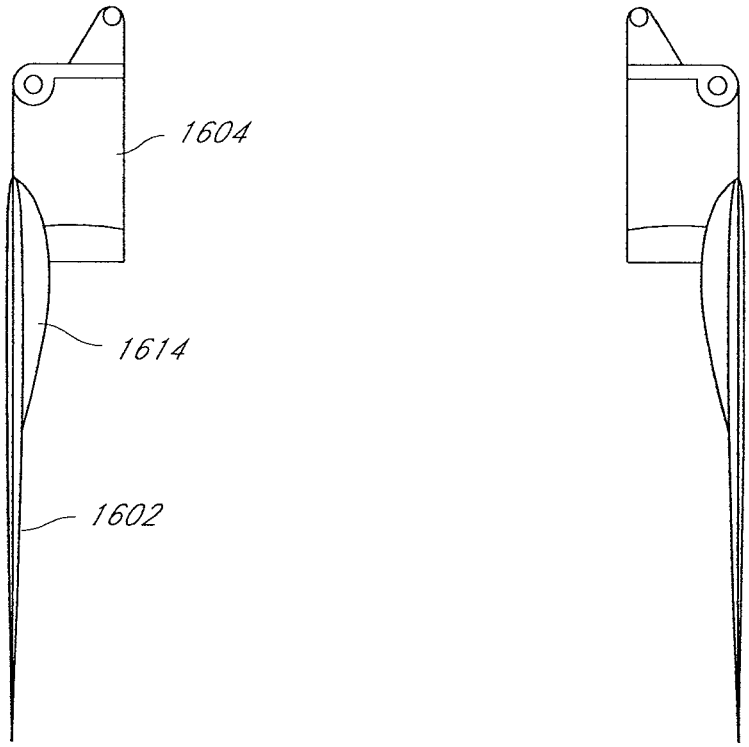
FIG. 16D illustrates a side high drag or power phase view of the hilo and carriage of FIG. 16A.
Figure 16E:
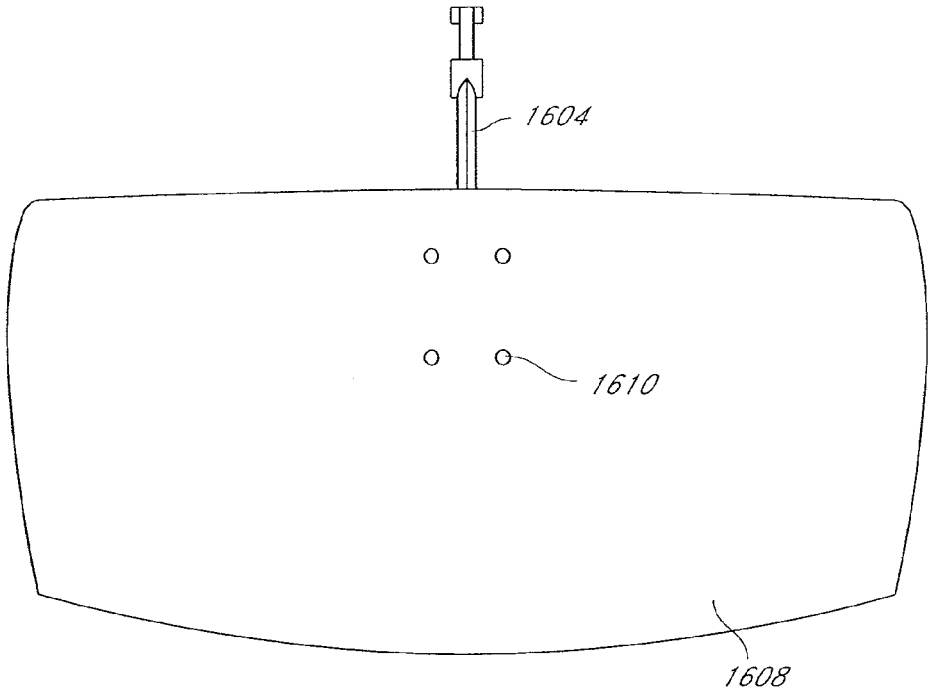
FIG. 16E illustrates a bottom high drag or power phase view of the hilo and carriage of FIG. 16A.
Figure 16F:
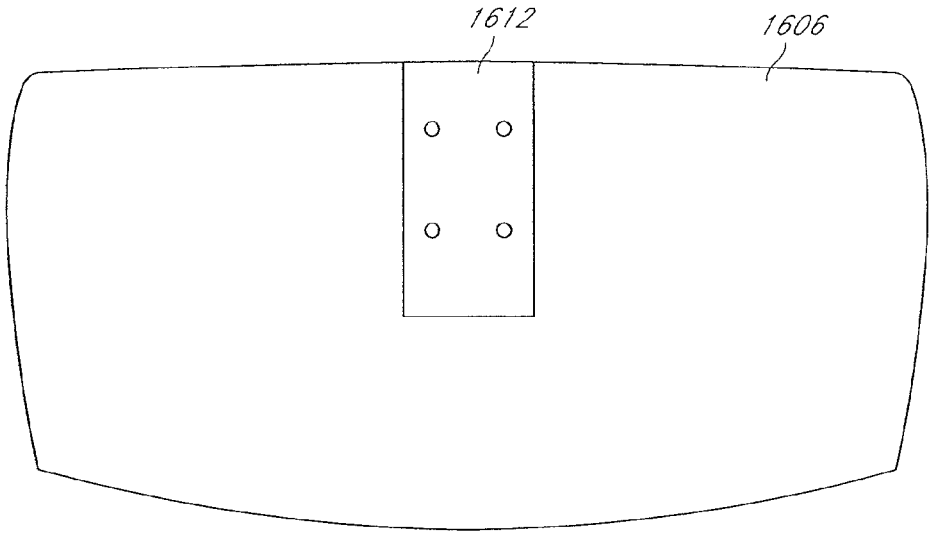
FIG. 16F illustrates a top view of the hilo of FIG. 16A.
Figure 16G:
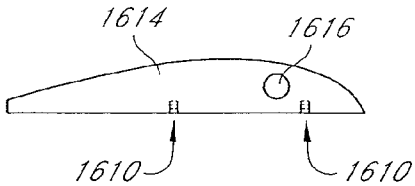
FIG. 16G illustrates a side view of the hilo hinge assembly of FIG. 16A.
Figure 17A:
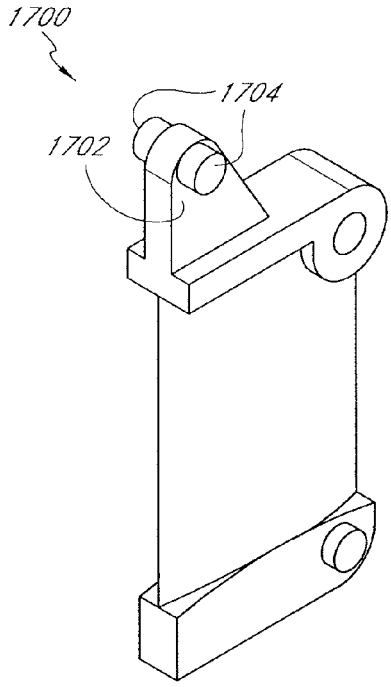
FIGS. 17A-B illustrate simplified exemplary top front and rear perspective views of a carriage according to an embodiment of the disclosure.
Figure 17B:
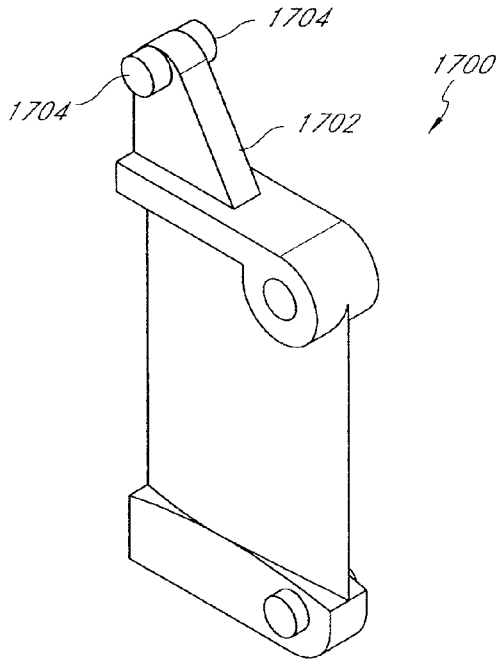
Figure 17C:
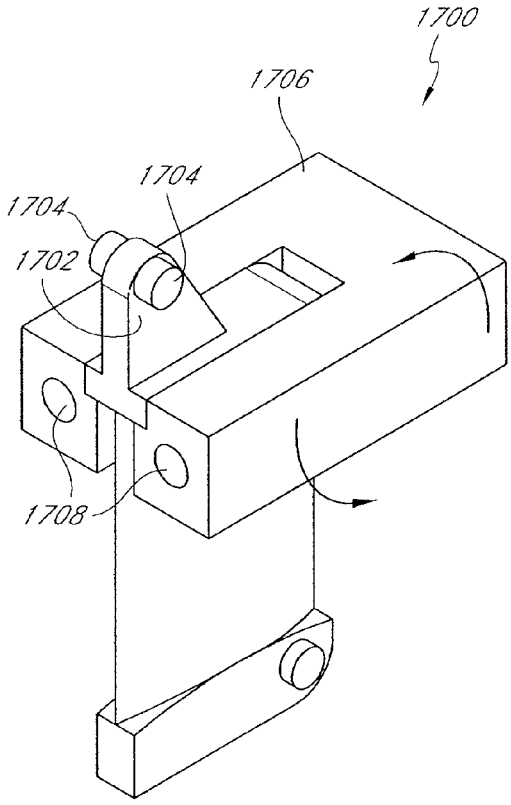
FIGS. 17C-D illustrate a simplified exemplary top front and rear perspective views of the carriage of FIG. 17A including a guide member.
Figure 17D:
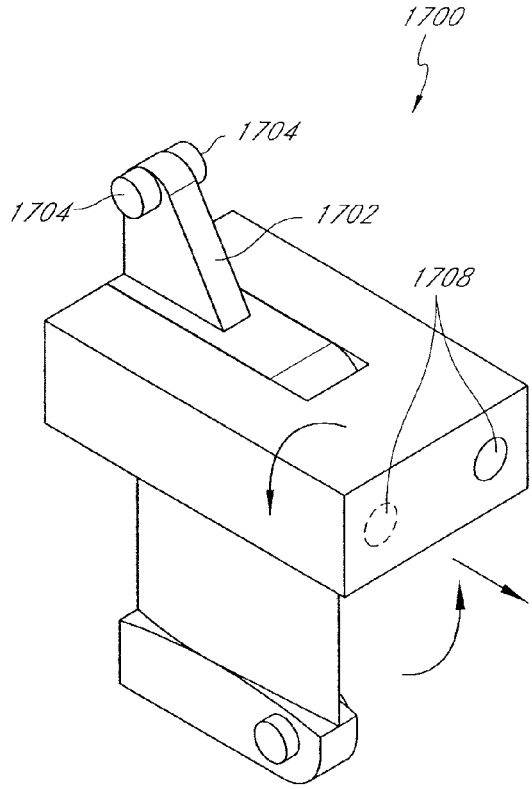

FIGS. 16A-16B illustrate simplified exemplary front and rear views of a hilo 1602 and carriage 1604 according to an embodiment of the disclosure. FIG. 16C illustrates a side low drag or recovery phase view of the hilo 1602 and carriage 1604. Moreover, FIG. 16D illustrates a side high drag or power phase view, while FIG. 16E illustrates a bottom high drag or power phase view. FIG. 16F illustrates a top view of the hilo 1602 while FIG. 16G illustrates a side view of the hilo hinge assembly 1606.

As shown in FIGS. 16E and 16F, a bottom surface 1608 of the hilo 1602 may comprise a slightly flexible material while a top surface 1606 may comprise a compressible flexible foam. The flexible foam advantageously compresses when pressed up against the hull 102 in the stored position. Area 1612 may further include reinforced harder material, or the flexible material of the bottom 1608 to assist in longevity as area 1612 will house the hilo hinge 1614 the set screws through screw holes 1610, and may press against the carriage during the power phase.

FIGS. 17A-17D illustrate simplified exemplary top front and top rear perspective views of a carriage 1700 according to an embodiment of the disclosure. As shown, the carriage 1700 includes an articulator 1702 having guide pins 1704 extending from the articulator. Moreover, the carriage 1700 includes track guides 1706 extending from the articulator sufficiently to stabilize the carriage 1700 in a track. In an embodiment, at least the rearward track guide 1706 includes through holes 1708 allowing for one or more of the shafts 238 to slide therethrough. The carriage 1700 also includes a lower pins 1710 for huggable attachment to the hilo 1602.

Figure 18A:
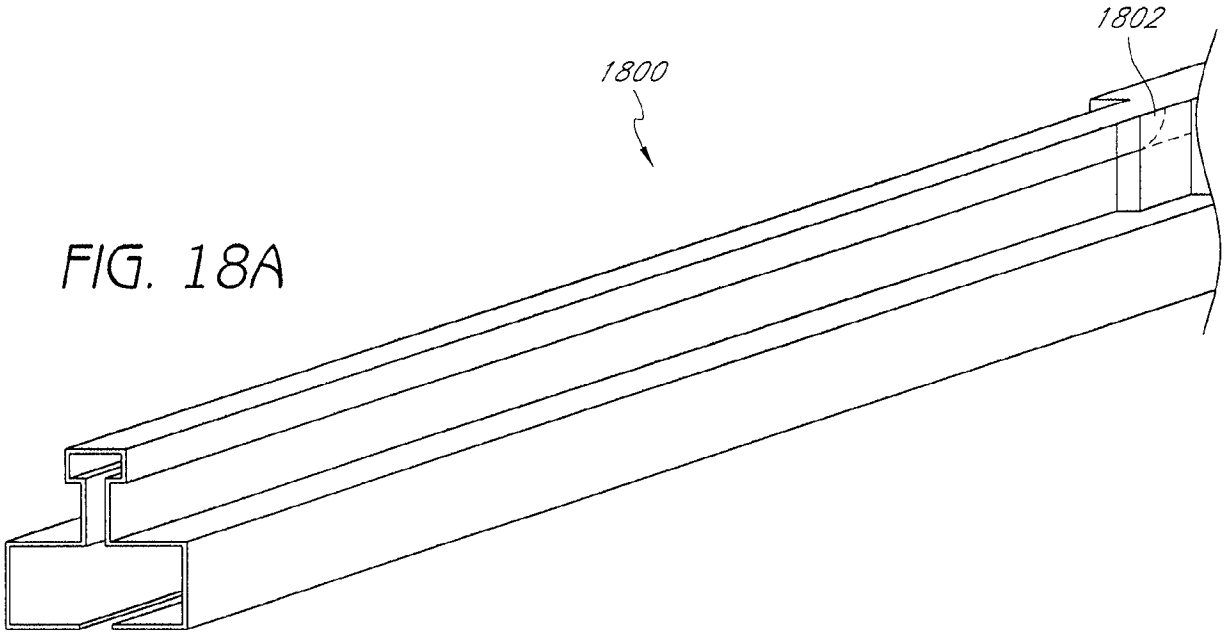
FIG. 18A illustrates a simplified exemplary top front perspective view of a portion of a track according to an embodiment of the disclosure.
Figure 18B:
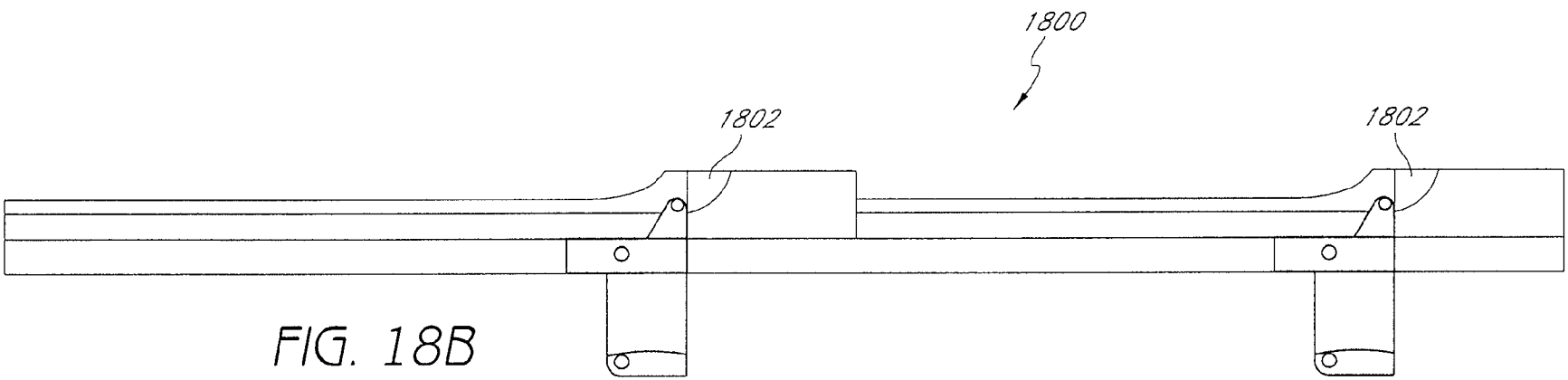
FIG. 18B illustrates a simplified exemplary side view of the track of FIG. 18A.

FIG. 18A illustrates a simplified exemplary top front perspective view of a portion of a hollow track 1800 according to an embodiment of the disclosure, while FIG. 18B illustrates a simplified exemplary side view of the track 1800. As shown, the track 1800 includes a hollow shape adapted to accept the carriage, such as carriage 1700. The track 1800 includes stops 1802 that engage the track pins 1704 to allow for storage of a hilo devices. In an embodiment, the track 1800 is hollowed out of the hull 102. In other embodiments, the track 1800 may comprise reinforced composite materials or even metal.

Figure 19A:
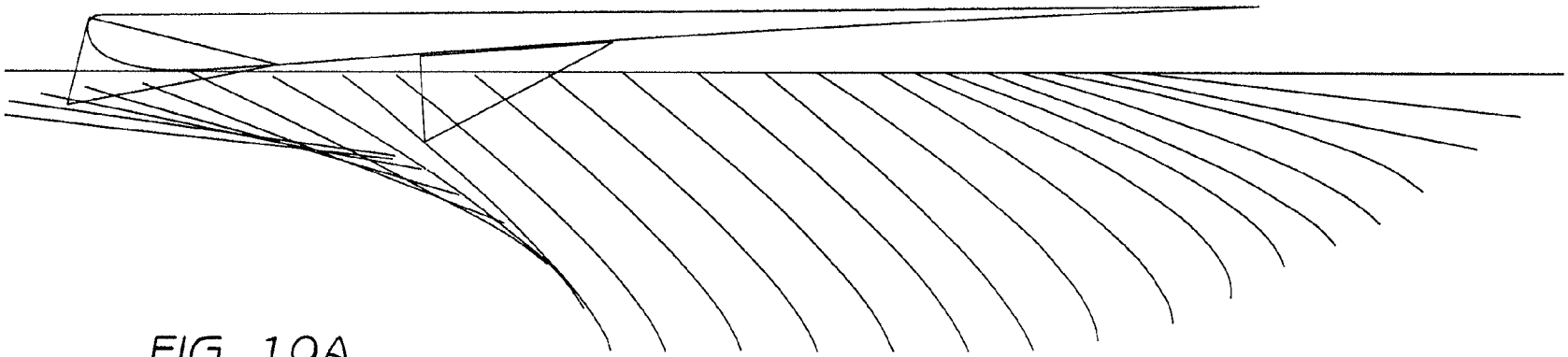
FIG. 19A illustrates exemplary action of a flexible hilo in the power phase according to an embodiment of the disclosure.
Figure 19B:
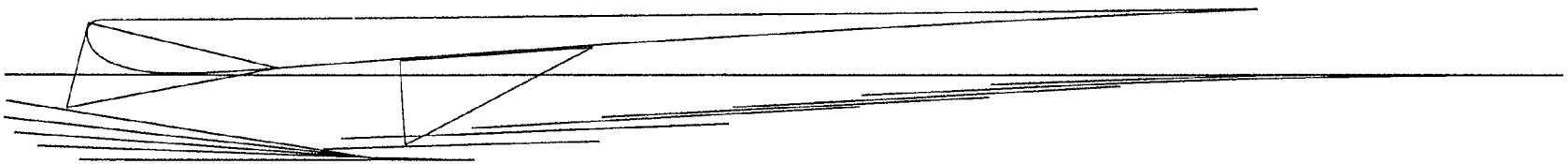
FIG. 19B illustrates exemplary action of a flexible hilo in the recovery phase according to an embodiment of the disclosure.

FIGS. 19A-19B illustrate exemplary actions of a more flexible hilo in the power phase and the recovery phase, respectively, according to an embodiment of the disclosure. As shown, the flexible hilo tends to have action similar to a fish swimming.

Figure 20A:
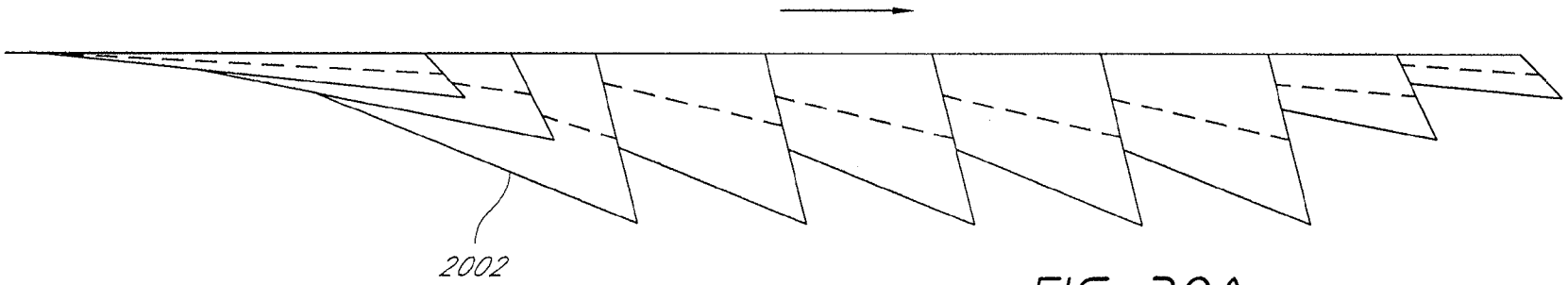
FIG. 20A illustrates exemplary action of a hilo comprising a bag in the power phase according to an embodiment of the disclosure.
Figure 20B:
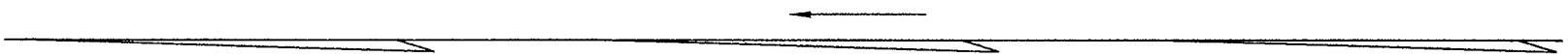
FIG. 20B illustrates exemplary action of a hilo comprising a bag in the recovery phase according to an embodiment of the disclosure.

FIGS. 20A-20B illustrate exemplary actions of a hilo comprising a bag 2002 in the power phase and the recovery phase, according to an embodiment of the disclosure. The bag 2002 comprises a bellows type inflatable structure shaped to inflate to the approximate shape of a hollow wedge. Such a shape is advantageously straightforward to make and has very little impact on the shape of the bottom 112 of the hull 102 when, for example, the bag 2002 is in a stowed position. However, the bag 2002 may open slower than other hilo devices and may not provide sufficient or desired lift.

Figure 21A:
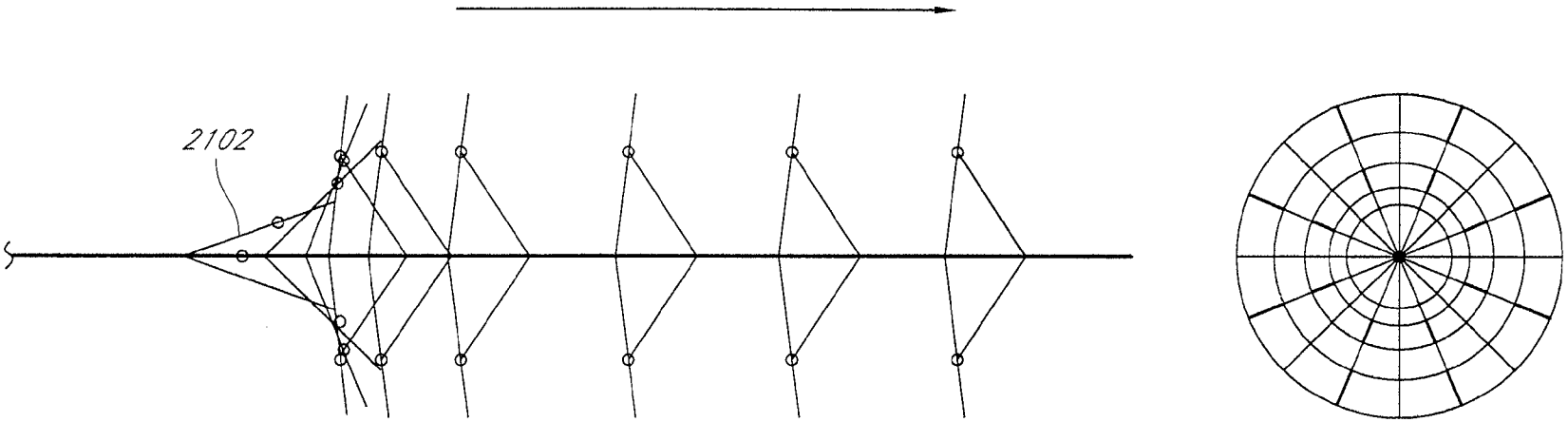
FIG. 21A illustrates exemplary action of a hilo comprising a chute in the power phase according to an embodiment of the disclosure.
Figure 21B:
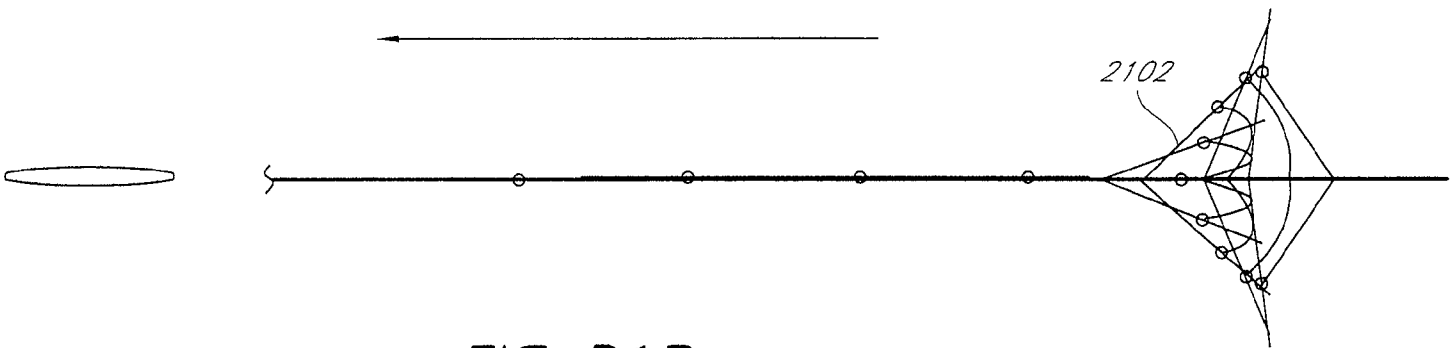
FIG. 21B illustrates exemplary action of a hilo comprising a chute in the recovery phase according to an embodiment of the disclosure.

FIGS. 21A-21B illustrate exemplary actions of a hilo comprising a chute 2102 in the power phase and the recovery phase, according to an embodiment of the disclosure. The chute 2102 may advantageously act similar to a parachute or umbrella and deploys from cylindrical cavities in the bottom of the hull 102. The propelling action of the parachute is akin to a squid. As shown, the chute 2102 includes structural bracing to ensure proper shape during the power phase.

Figure 22A:
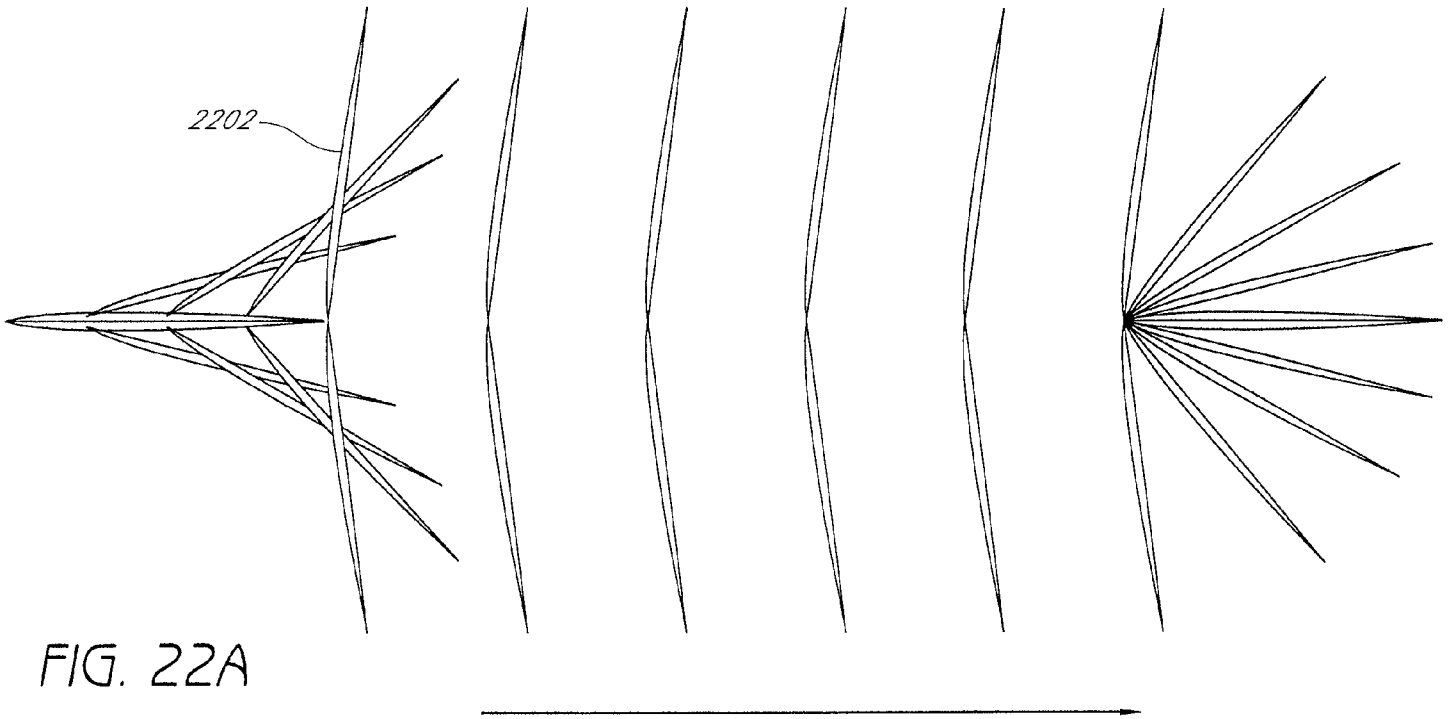
FIG. 22A illustrates exemplary action of a hilo comprising a split foil in the power phase according to an embodiment of the disclosure.
Figure 22B:
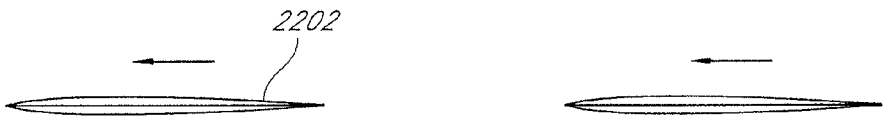
FIG. 22B illustrates exemplary action of a hilo comprising a split foil in the recovery phase according to an embodiment of the disclosure.

FIGS. 22A-22B illustrate exemplary action of a hilo comprising a split foil 2202 in the power phase and in the recovery phase, according to an embodiment of the disclosure. As shown, the split foil 2202 opens quickly increasing the efficiency of the power stroke. Moreover, the hull 104 may advantageously include cylindrical cavities in the bottom of the hull to provide for deployment during the power stroke.

Figure 23:
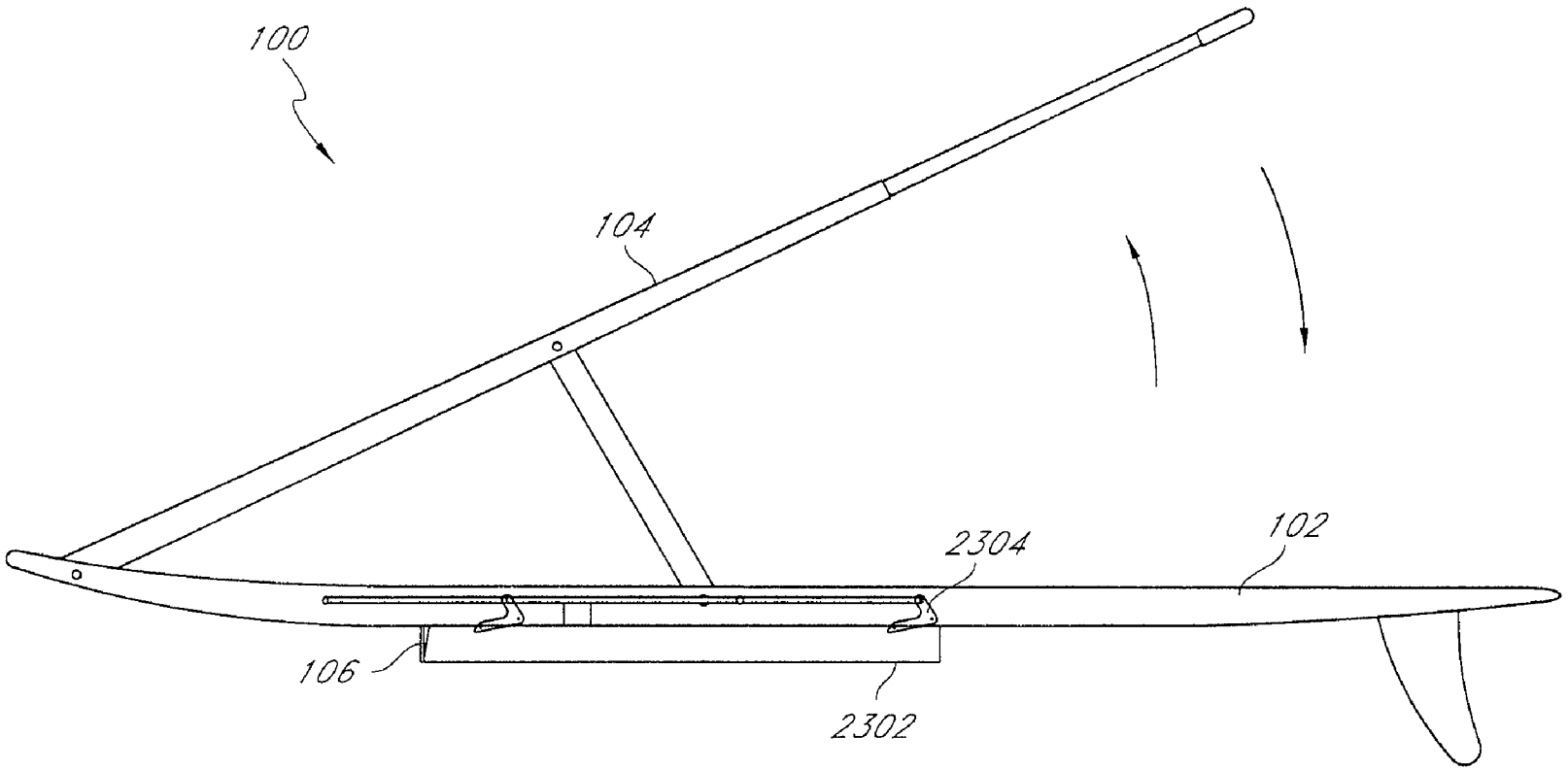
FIG. 23 illustrates a simplified exemplary deployable channel according to an embodiment of the disclosure.

FIG. 23 illustrates a simplified exemplary deployable channel 2302 according to an embodiment of the disclosure. As shown, a pair of deployable channels 2302 each comprises a "U" shaped cross section and include a length running lengthwise along the hull 102. In an embodiment, each channel 2302 comprises a length of about four feet (4 ft); however, an artisan will recognize from the disclosure herein a wide number of geometries for the channel 2302.

In a preferred embodiment, the hull 102 includes grooves running lengthwise down the board such that the vertical arms of the "U" shaped cross section extend into the grooves when the channels 2302 are retracted. In an embodiment, the retracted channels 2302 present a smooth bottom surface of the board; although an artisan will recognize from the disclosure herein that the thickness of the bottom surface of the channels 2302 may protrude from the bottom surface of the hull 102 without causing significant drag. Moreover, the channels 2302 may include tapered edges at the front edge (in their cross section) designed to further reduce drag when in their retracted, or for that matter, deployed position.

As shown, each channel 2302 is suspended from the hull 102 via the brackets 2304, which pivot to lower the channel out of the grooves and below the bottom surface of the hull 102 to form an enclosed tube, tunnel or "channel" having the three surfaces forming the "U" shape, and a top surface being the bottom of the hull 104. In an embodiment, the brackets 2304 operate to pivot one or more of the carriage, the fin and the linkages into appropriate positions for actuation thereof. For example, the carriage moves back and forth along the channel according to the actuation of the levers 104. A pivoting hilo is attached to the carriage and in a preferred embodiment, travels back and forth within the channel 2302. Once the channel 2302 is deployed, it fills with water. Actuation of the lever 104 downward causes the carriage to begin to move toward the back of the channel. The water within the channel 2302 catches the pivoting hilo fin and causes it to pivot downward into a vertical position that corresponds to the high drag power stroke position. The high drag position substantially seals off the water in the channel 2302 from flowing back through the front end thereof. As the lever 104 continues rearward in its power stroke, the fin forces the captured water out the rear of the channel 2302, thereby propelling the hull 102 forward.

An artisan will recognize from the disclosure herein that the shape of the channel, the carriage, the fin, the cross section of the channel (particularly the cross section of the channel where the water exits), or the like, may each be shaped to increase propulsion force and/or efficiency. For example, differing exit nozzles or the like may be used to improve desired performance such as top speed, acceleration, lever actuation difficulty, or the like.

During the power stroke, the fin moves backward such that new water fills the channel in front of the fin. However, because the fin is moving backward at least as fast as the hull 102 is moving forward, and preferably faster, the new water abutting the fin creates no or insignificant additional drag. When the lever 104 is lifted, or in its recovery stroke, the carriage begins to move forward and the newly filled water in the channel causes the fin to pivot into its low drag position. During the recovery stroke, the channel continues to be full of flowing water having little drag and ready for the next power stroke.

When retracted, the side-by-side channels 2302 fit within appropriate cavities within the hull 102. The retracted position presents a board deck and bottom surface substantially similar to that of conventional surfboards. However, an artisan will recognize from the disclosure herein that the propulsion system may only partially retract or simply not retract one or more of its components. Although disclosed with reference to a fin moving with the channel 2302, the channel may move to cause the hull 104 to move forward. For example, the channel 2302 may advantageously open in the front, then close the front leaving the rear open, then squeezing the rear closed to force the water out of the channel, reopen the front, fill and repeat.

Although the foregoing disclosure has been described in terms of certain preferred embodiments, other embodiments will be apparent to those of ordinary skill in the art from the disclosure herein. For example, in an alternative embodiment, the propulsion system includes extending oars or paddles that, for example, flare out with each power stroke of the lever. Alternatively, the propulsion system may convert the mechanical lever action to power a boat screw or the like. The boat screw may be inside a channel. Moreover, the surfboard may include, for example, retractable or other stabilizing fins, pontoons, outriggers, or the like to provide stability at low speeds.

Additionally, a skilled artisan will recognize from the disclosure herein that the watercraft may comprise one, two, or more levers, one, two, or more hilo devices, combinations of the same or the like. Moreover, the watercraft may employ human actuation devices other than levers. Also, the power stroke and/or recovery stroke duty cycle of each hilo may be more or less than fifty percent (50%) to, for example, alter top speed, alter human effort, or the like Additionally, other combinations, omissions, substitutions and modifications will be apparent to the skilled artisan in view of the disclosure herein. Moreover, it is contemplated that various aspects and features of the invention described can be practiced separately, combined together, or substituted for one another, and that a variety of combination and subcombinations of the features and aspects can be made and still fall within the scope of the invention. Furthermore, the systems described above need not include all of the components and functions described in the preferred embodiments. Accordingly, the present invention is not intended to be limited by the recitation of the preferred embodiments, but is to be defined by reference to the appended claims.

Additionally, all publications, patents, and patent applications mentioned in this specification are herein incorporated by reference to the same extent as if each individual publication, patent, or patent application was specifically and individually indicated to be incorporated by reference.

What is claimed is:

1. A lever-powered watercraft comprising:

a hull having a rider side;

a plurality of lever assemblies, each lever assembly including a grip portion and a pivot portion, the grip portion independently movable with respect to the pivot portion, the pivot portion operably mounted off-center of the rider side of the hull, thereby positioning the grip portions of the lever assemblies on either side of a center-positioned rider; and a propulsion assembly including devices capable of a high drag orientation, the propulsion assembly operably coupled to the pivot portion of the lever assemblies, wherein power stroke rider actuation of each grip portion translates into at least one device in the high drag orientation propelling the hull forward.

2. The lever-powered watercraft of claim 1, wherein each grip portion telescopes with respect to each corresponding pivot portion of each lever assembly.

3. The lever-powered watercraft of claim 1, wherein the hull comprises a surfboard.

4. The lever-powered watercraft of claim 1, wherein the propulsion assembly comprises a hydraulic system.

5. The lever-powered watercraft of claim 1, wherein the forward motion of the hull causes the lever assemblies to stow when released.

6. The lever-powered watercraft of claim 1, wherein devices capable of the high drag orientation comprises at least one of a fin, a bag, a cone, a foil, an oar, and a deployable channel.

7. The lever-powered watercraft of claim 1, wherein devices capable of the high drag orientation comprises an oar.

8. A lever-powered watercraft comprising:

a hull including a deck;

a propulsion assembly, wherein activation of the propulsion assembly propels the hull forward; and first and second levers positioned on either side of a rider, wherein an up motion of one of the first and second levers corresponds to moving the lever away from the deck and a down motion corresponds to moving the lever toward the deck, the up and down motions of the first and second levers translate into power and recovery strokes of the propulsion assembly, wherein the watercraft includes a stowed configuration for at least portions of the propulsion assembly and the first and second levers, and wherein under certain conditions, the forward movement of the watercraft automatically returns the watercraft to its stowed configuration.

9. The lever-powered watercraft of claim 8, wherein the down motion of the first and second levers corresponds to the power stroke and wherein the stowed configuration for each lever is before the recovery stroke.

10. The lever-powered watercraft of claim 8, wherein the hull comprises a surfboard.

11. The lever-powered watercraft of claim 8, wherein the propulsion assembly includes devices capable of the high drag orientation, said devices comprising at least one of a fin, a bag, a cone, a foil, an oar, and a deployable channel.

12. The lever-powered watercraft of claim 8, wherein the propulsion assembly includes devices capable of the high drag orientation, said devices comprising oars.

13. A lever-powered watercraft comprising:

a hull;

a translation device configured to translate up and down motion into different motion capable of activating at least one high drag device to propel the hull forward; and at least one lever operably coupled to the translation device, wherein the lever includes a pivot end and a power end, the power end configured to travel up and down with respect to the hull, wherein the translation device creates a mechanical advantage with respect to the high drag device, and wherein the translation device comprises gearing.

14. The lever-powered watercraft of claim 13, comprising a propulsion assembly and wherein the propulsion assembly includes the translation device and the high drag device.

15. The lever-powered watercraft of claim 13, wherein the hull comprises a surfboard.

16. The lever-powered watercraft of claim 13, wherein the lever and the high drag device are configurable for stowage before a recovery stroke of the high drag device.

17. The lever-powered watercraft of claim 13, wherein the lever comprises two levers positioned on either side of a rider, and wherein each lever includes portions movable with respect to one another.

18. A lever-powered watercraft comprising:

a hull;

a translation device configured to translate up and down motion into different motion capable of activating at least one high drag device to propel the hull forward; and at least one lever operably coupled to the translation device, wherein the lever includes a pivot end and a power end, the power end configured to travel up and down with respect to the hull, wherein in various configurations, the forward motion of the hull causes the lever and the high drag device to be stowed.

* * * * *